United States Patent [19]

Hanada et al.

[11] Patent Number: 4,867,436

[45] Date of Patent: Sep. 19, 1989

[54] SHEET ALIGNING ARRANGEMENT

[75] Inventors: Yoshihiro Hanada; Yasuo Nakamura, both of Toyokawa; Kazuyuki Fukui, Toyohashi, all of Japan

[73] Assignee: Minolta Camera Kabushiki Kaisha, Osaka, Japan

[21] Appl. No.: 240,363

[22] Filed: Sep. 1, 1988

Related U.S. Application Data

[63] Continuation of Ser. No. 875,870, Jun. 18, 1986, abandoned.

[30] Foreign Application Priority Data

Jul. 2, 1985 [JP] Japan ..... 60-146152
Jul. 4, 1985 [JP] Japan ..... 60-148071
Jul. 4, 1985 [JP] Japan ..... 60-148072

[51] Int. Cl.[4] ..... B65H 31/36
[52] U.S. Cl. ..... 271/221; 271/222
[58] Field of Search ..... 271/3.1, 246, 221, 222; 414/36, 28

[56] References Cited

U.S. PATENT DOCUMENTS 3,733,070 5/1973 Obenshain ..... 271/221
4,058,226 11/1977 Peters, Jr. ..... 271/221 X
4,318,541 3/1982 Nagel et al. ..... 271/222

*Primary Examiner*—Joseph J. Rolla
*Assistant Examiner*—Boris Milef
*Attorney, Agent, or Firm*—Burns, Doane, Swecker & Mathis

[57] ABSTRACT

A sheet aligning arrangement adapted to accommodate a plurality of sheets fed into it for aligning, and to feed out the aligned sheets one sheet by one sheet. The arrangement includes a feed roller, a first aligning member movable between a first position defining a sheet aligning reference position and a second position parallel to the first position and defining a sheet transport reference position, a second aligning member located in a position confronting the first aligning member, and pivotable in a direction intersecting at right angles with a sheet transport direction, and a displacing device for displacing the first aligning member to the first position during the alignment to effect aligning together with the second aligning member, and also for displacing the first aligning member to the second position during the re-feeding of the sheets by the feed roller, while pivoting the second aligning member to align the sheets.

11 Claims, 18 Drawing Sheets

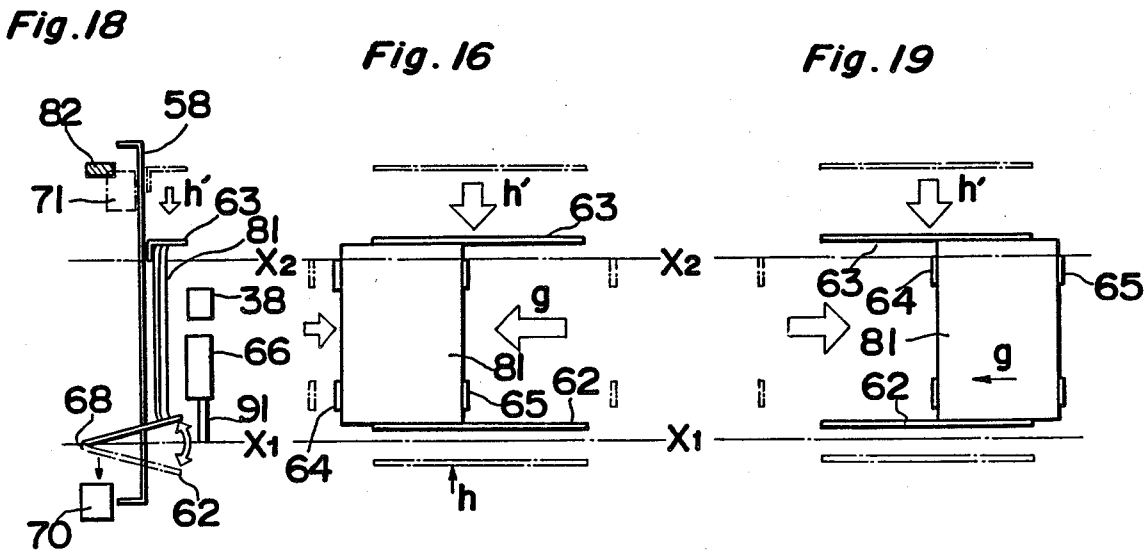
Fig. 18
Fig. 16
Fig. 19
58
82
71
h'
63
81
X2
38
66
91
X1
62
68
70
h
64
65
g
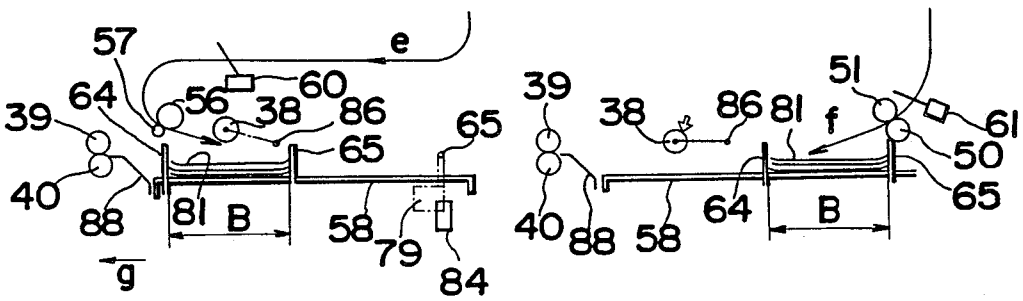
Fig. 17
Fig. 20
e
60
56
57
38
86
65
58
79
84
81
B
64
39
40
88
g
61
50
51
f
58

SHEET ALIGNING ARRANGEMENT

This application is a continuation, of application Ser. No. 06/875,870, filed June 18, 1986, abandoned.

BACKGROUND OF THE INVENTION

The present invention generally relates to a sheet aligning arrangement, for example, the one which is used for a copying apparatus and arranged to receive copy paper sheets fed thereinto for alignment, and to re-feed one sheet by one sheet the aligned copying paper sheets, in the case of duplex copying, composite copying, etc.

Recently, for example, in the field of copying system, there have been copying apparatuses developed provided with various functions such as the so-called duplex copying which copies on front and reverse surfaces of a copy paper sheet, and composite copying which effects copying on the same side face of a copy paper sheet in different images (e.g., a frame and letters in the frame) or by toners of different colors. In order to carry out such functions as referred to above, it is necessary to once feed the paper sheets after copying onto an intermediate tray for refeeding therefrom.

In the above case, if the copy paper sheets stacked on the intermediate tray are not properly aligned, there is a possibility that troubles in feeding such as simultaneous feeding of a plurality of copy paper sheets, paper jamming, etc. may take place during the re-feeding, and in order to prevent such troubles, it is required to align the copy paper sheets accurately at a transport reference position on the intermediate tray.

Accordingly, it has been a conventional practice to provide a widthwise direction regulating roller which is driven for rotation in an inclined state with respect to the transport reference position, thereby to displace any copy paper sheet fed in from the transport reference position with a positional deviation, toward a transport reference corner portion. Another known practice is such that, as disclosed in U.S. Pat. No. 3,645,615, the copy paper sheets are aligned with a transport reference position through tapping on opposite sides of the copy paper sheets by pivoting position regulating members provided on opposite sides inwardly or outwardly.

However, in the former practice, there is such a problem that for example, when an upwardly curled copy paper sheet is fed in, such curled copy paper sheet is undesirably folded by the widthwise direction regulating roller, while it is difficult to adjust the contact pressure of the roller to correspond to the number of copy paper sheets fed in.

Meanwhile, in the latter practice, there is also such a disadvantage that the copy paper sheets undesirably jump when the position regulating members tap on the opposite sides of said sheets, thus resulting in deterioration in the alignment to give rise to faulty re-feeding of the copy paper sheets.

On the other hand, in order to prevent such faulty re-feeding of the copy paper sheets, it is also necessary to guide the copy paper sheets by side regulating plates at the transport reference position during the re-feeding.

Furthermore, in the above case, together with the correct alignment of the copy paper sheets fed onto the intermediate tray at the re-feeding position, it is also necessary to simultaneously open a re-feeding passage for the copy paper sheets. Therefore, in the conventional arrangements, the forward edge portion of the intermediate tray is adapted to be raised higher in position than a leading edge regulating means for the copy paper sheets.

However, since the intermediate tray is a comparatively large member, not only a large-sized mechanism is required for pivoting such intermediate tray, but a sufficient space is required for the pivotal movement thereof, thus resulting in a large size of the copying apparatus itself.

SUMMARY OF THE INVENTION

Accordingly, an essential object of the present invention is to provide an improved sheet aligning arrangement which is capable of positively and accurately aligning the sheets at a transport reference position, without any possibility of faulty re-feeding or deterioration in aligning performance, with substantial elimination of disadvantages inherent in the conventional arrangements of this kind.

Another important object of the present invention is to provide a sheet aligning arrangement of the above described type which is simple in construction and stable in functioning, and can be readily incorporated into various copying apparatuses at low cost.

In accomplishing these and other objects, according to one preferred embodiment of the present invention, there is provided a sheet aligning arrangement which is arranged to accommodate a plurality of sheets fed thereinto for alignment, and to feed out the aligned sheets therefrom one sheet by one sheet, and includes a feed roller means for feeding the sheets, a first aligning member movable between a first position which defines a sheet aligning reference position and a second position parallel to said first position and defining a sheet transport reference position, a second aligning member located in a position confronting said first aligning member, and pivotable in a direction intersecting at right angles with a sheet transport direction, and a displacing means which displaces said first aligning member to the first position during the alignment, to effect aligning together with said second aligning member, and also displaces said first aligning member to the second position during the re-feeding of the sheets by said feed roller means, while pivoting said second aligning member to align the sheets.

By the above construction of the present invention, an improved sheet aligning arrangement has been presented through simple construction.

BRIEF DESCRIPTION OF THE DRAWINGS

These objects and features of the present invention will become apparent from the following description taken in conjunction with the preferred embodiment thereof with reference to the accompanying drawings, in which:

FIG. 16 is a top plan view of the alignment mechanism of FIG. 5 at the time of turnover copying;

FIG. 17 is a front elevational view of FIG. 16;

FIG. 18 is a side elevational view of FIG. 16;

FIG. 19 is a top plan view of the alignment mechanism at the time of composite copying;

FIG. 20 is a front elevational view of FIG. 19;

Before the description of the present invention proceeds, it is to be noted that like parts are designated by like reference numerals throughout several views of the accompanying drawings.

DETAILED DESCRIPTION OF THE INVENTION

Figure 1:
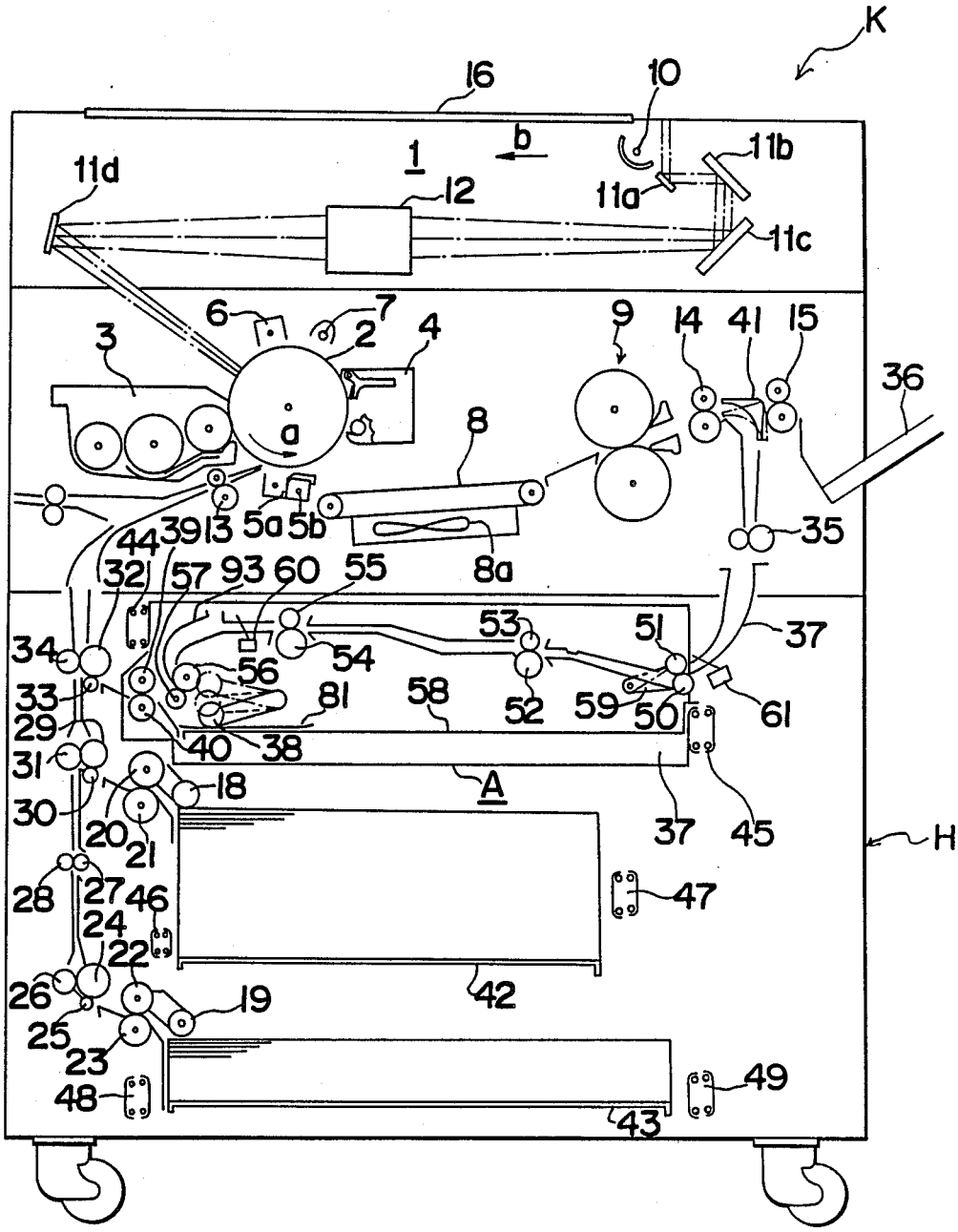
FIG. 1 is a view showing a whole construction of a copying apparatus according to one embodiment of the present invention.

Hereinbelow, a copying apparatus K provided with a sheet aligning arrangement according to one preferred embodiment of the present invention will be described with reference to the accompanying drawings.

Initially, a whole construction and operations of the copying apparatus K is described with reference to FIG. 1. The copying apparatus K includes a photosensitive drum 2 provided at a central portion of an apparatus housing H of the copying apparatus K and rotatable in the direction of the arrow a. Around the photosensitive drum 2, a corona charger 6, a magnetic brush type developing device 3, a transfer charger 5*a*, a charge eraser 5*b*, a blade type cleaning device 4 and an eraser lamp 7 are sequentially disposed in this order. Upon rotation of the photosensitive drum 2 in the direction of the arrow a, the photosensitive drum 2 is subjected to uniform corona charging by the corona charger 6 and then, is subjected to exposure by an optical system 1 such that an electrostatic latent image is formed on the photosensitive drum 2. The electrostatic latent image is developed into a visible toner image by the developing device 3.

The optical system is movably provided below an original platform 16 made of glass so as to scan an original document on the original platform in the direction of the arrow b and is constituted by a light source 10, movable mirrors 11*a*, 11*b* and 11*c*, an imaging lens 12 and a fixed mirror 11*d*. When the drum 2 rotates at a peripheral velocity V (which is constant irrespective of magnification), the light source 10 and the movable mirror 11*a* travel unitedly leftward at a velocity of V/m (where m is a magnification), while the movable mirrors 11*b* and 11*c* travel unitedly leftward at a velocity of V/2 m.

On the other hand, a copy paper storage portion is constituted by an upper storage portion 42 of elevator type and a lower storage portion 43 of cassette type, which are drawably provided so as to be drawn out of the apparatus housing H forwardly by using rails 46 and 47 and rails 48 and 49, respectively. Copy paper sheets stacked in the upper storage portion 42 and the lower storage portion 43 are transported and separated from the remaining sheets in the stack by a pair of separating rollers 20 and 21 and a pair of separating rollers 22 and 23, one sheet by one sheet upon rotation of paper feeding rollers 18 and 19, respectively and then, are conveyed to timing rollers 13 via a group of transport rollers 29, 30, 31, 32, 33 and 34 and a group of transport rollers 24, 25, 26, 27 and 28, respectively. After the copy paper sheets have been temporarily stopped at the timing rollers 13, the copy paper sheets are transported to a transfer portion synchronously with the above described toner image formed on the photosensitive drum 2 such that the toner image is transferred onto the copy paper sheets through electric discharge of the transfer charger 5*a*. In addition, the copy paper sheets are separated from the surface of the photosensitive drum 2 through electric discharge of the charge eraser 5*b* and then, are conveyed to a fixing device 9 by a transport belt 8 including an air suction means 8*a* such that the toner image on the copy paper sheets is subjected to fusion fixing by the fixing device 9.

A lever 41 for effecting changeover of a feed passage of the copy paper sheets is provided between transport rollers 14 and discharge rollers 15, with the transport rollers 14 being disposed in the close vicinity of the outlet of the fixing device 9. In the case where the copy paper sheets are discharged directly to a tray 36, the lever 41 is set at the position shown by the one-dot chain lines of FIG. 1 and thus, the copy paper sheets transported from the fixing device 9 are discharged from the outlet rollers 15 onto the tray 36. Meanwhile, in the case where duplex copying or composite copying to be described later in detail is performed, the lever 41 is set at the position shown by the solid lines of FIG. 1 and thus, the copy paper sheets are conveyed from transport rollers 35, through a guide plate 37, to an intermediate tray unit A to be described later.

On the other hand, after the toner image on the photosensitive drum 2 has been transferred onto the copy paper sheets, residual toner is removed from the photosensitive drum 2 by the cleaning device 4 and residual electric charge is removed from the photosensitive drum 2 by light irradiated by the eraser lamp 7 such that the photosensitive drum 2 is ready for the next copying operation.

Hereinbelow, constructions of the intermediate tray unit A will be described briefly with reference to FIGS. 1 to 3. The intermediate tray unit A is designed to store the copy paper sheets each having one copied face so as to align the copy paper sheets with each other and re-feed the aligned copy paper sheets. The intermediate tray unit A is constituted by a changeover block I, a transfer block II, a turnover block III, an intermediate alignment block IV and a re-feeding block V which are integrally assembled with each other as one unit. The intermediate tray unit A is drawably supported, at its opposite sides, by rails 44 and 45 so as to be drawn out of the apparatus housing H forwardly, i.e. in the direction perpendicular to the feed passage of the copy paper sheets as shown in FIG. 2. The intermediate tray unit A is arranged to be drawn out of the apparatus housing H such that maintenance of the copying apparatus K and disposal of jamming of the copy paper sheets are facilitated.

The inner construction of the intermediate tray unit A will be explained in detail hereinbelow with reference to FIG. 3.

The changeover block I is arranged to direct the copied face of the copy paper sheets upwardly and downwardly when the copy paper sheets are transported into the intermediate tray unit A for duplex copying and composite copying, respectively. The changeover block I is constituted by transport rollers 50 and 51 and a changeover lever 59. Meanwhile, it can also be so arranged that the changeover block I is provided on the apparatus housing H without being provided in the intermediate tray unit A.

The transport block II is arranged to transport to the turnover block III described later the copy paper sheets to be subjected to duplex copying and is constituted by transport rollers 52, 53, 54 and 55 and guide plates 201, 202, 203 and 204. When the intermediate tray unit A has been drawn out of the apparatus housing H forwardly, the transport block II can be pivoted upwardly about a support shaft 95 as shown by the one-dot chain lines of FIG. 3 such that disposal of jamming of the copy paper sheets in the intermediate tray unit A is facilitated.

The turnover block III is constituted by turnover transport rollers 56 and 57 and a turnover guide plate 93 so as to turn over and convey into an intermediate tray 58 the copy paper sheets transported through the transport block II.

Figure 5:
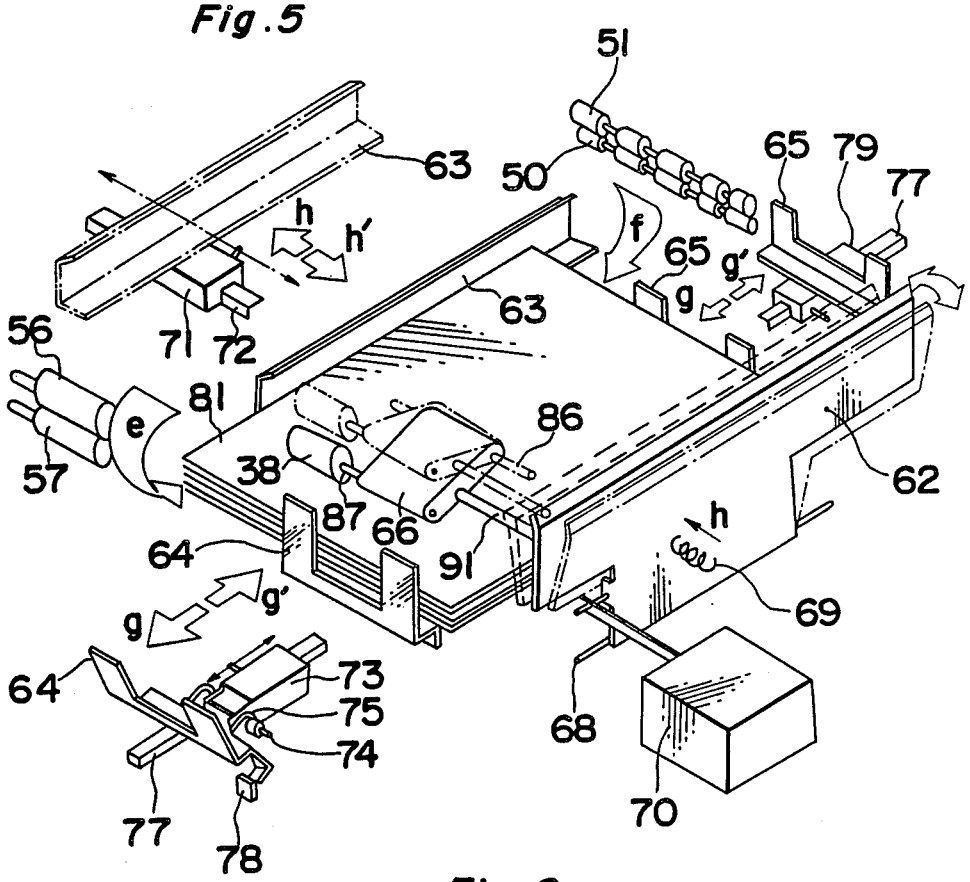
FIG. 5 is an exploded perspective view of an alignment mechanism and a re-feeding mechanism employed in the copying apparatus of FIG. 1.

The intermediate alignment block IV is constituted by the intermediate tray 58, a slide rail 77, slide members 73 and 79 and regulating plates 62, 63, 64 and 65 (the regulating plates 62, 63, 64 and 65 are shown in FIG. 5) so as to align with each other the copy paper sheets transported onto the intermediate tray 58.

Meanwhile, the re-feeding block V is constituted by a holder 66, a re-feeding roller 38, separating rollers 39 and 40 and a guide plate 88 so as to re-feed one sheet by one sheet the copy paper sheets aligned on the intermediate tray 58.

Figure 2:
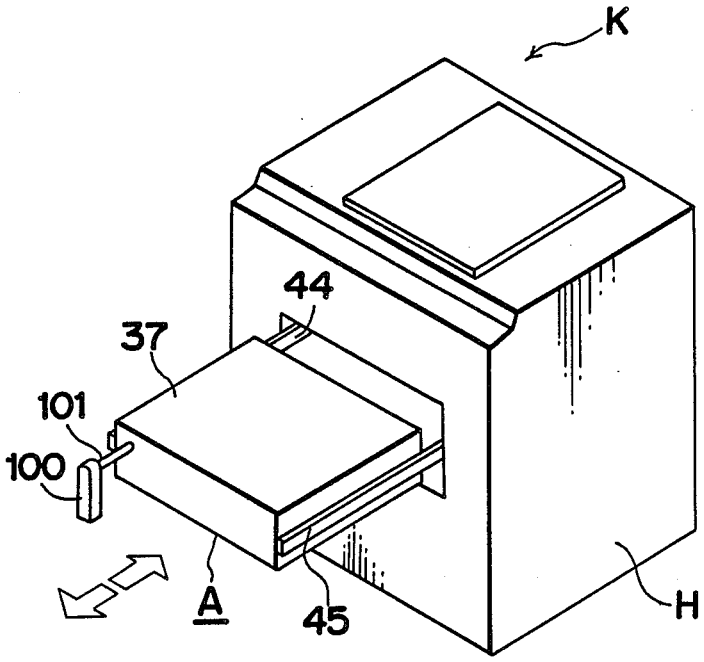
FIG. 2 is a perspective view of the copying apparatus of FIG. 1.

When either one of a duplex copying mode and a composite copying mode has been selected by depressing a selective key on an operating panel (not shown), the changeover lever 41 referred to earlier is changed over to the position shown by the solid lines of FIG. 1 and thus, the copy paper sheets each having one copied face are guided from the transport rollers 35 to the transport rollers 50 and 51 by the guide plate 37.

Figure 3:
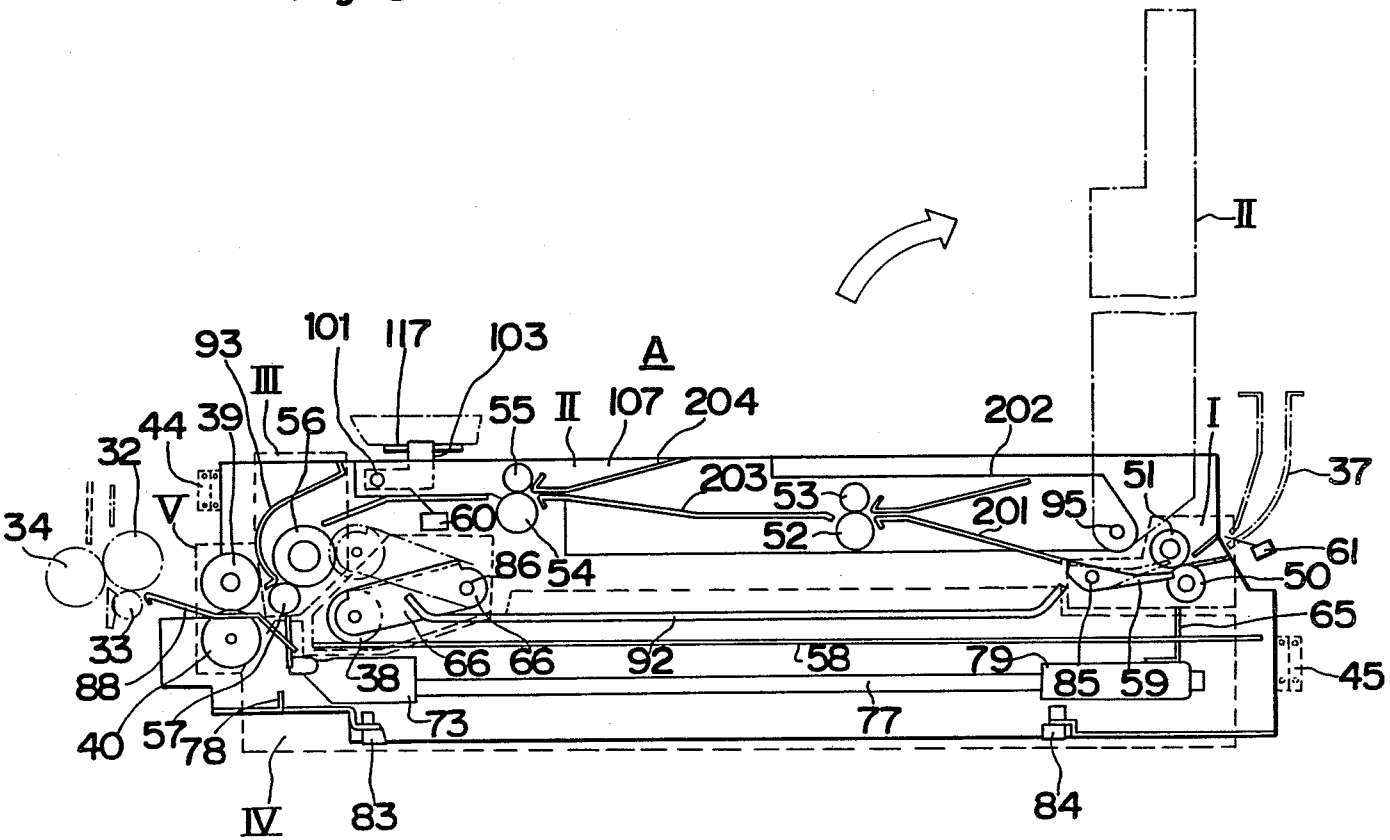
FIG. 3 is a view showing an inner construction of a unit employed in the copying apparatus of FIG. 1.

Another changeover lever 59 is pivotally provided so as to be pivoted about a shaft 85 and is set at the position shown by the solid lines of FIG. 3 at the time of duplex copying. At this time, the copy paper sheets fed into the intermediate tray unit A are guided to the transport block II by an upper face of the changeover lever 59 and then, are conveyed in the leftward direction in FIG. 3 by the transport rollers 52, 53, 54 and 55 through guide of the guide plates 201, 202, 203 and 204. Subsequently, the copy paper sheets are turned over by the turnover transport rollers 56 and 57 and the turnover guide plate 93 such that the copy paper sheets each having one copied face directed upwardly are transported onto the intermediate tray 58. Thereafter, the copy paper sheets are aligned with each other on the intermediate tray 58 by the intermediate alignment tray block IV so as to be re-fed one sheet by one sheet upon clockwise rotation of the re-feeding roller 38.

On the other hand, at the time of composite copying, the changeover lever 59 is set at the position shown by the one-dot chain lines of FIG. 3. At this time, the copy paper sheets are guided by a lower face of the changeover lever 59 immediately after having passed through the transport rollers 50 and 51 such that the copy paper sheets each having one copied face directed downwardly are directly conveyed onto the intermediate tray 58. Subsequently, the copy paper sheets are re-fed one sheet by one sheet upon clockwise rotation of the re-feeding roller 38 in the same manner as duplex copying.

The re-fed copy paper sheets are transported and separated from the remaining sheets in the stack by the separating rollers 39 and 40, and are transported to the timing rollers 13 via the transport rollers 32, 33 and 34. Thereafter, duplex copying or composite copying is performed in the same manner as an ordinary copying operation. Meanwhile, the re-feeding roller 38 is pivotally provided so as to be pivoted about a support shaft 86 of the holder 66 (see FIG. 3) such that the re-feeding roller 38 is positioned at three stages shown by the one-dot chain lines, the dotted lines and the solid lines in FIG. 1, respectively. When the copy paper sheets are transported to the intermediate tray 58, the re-feeding roller 38 is positioned at the upper stage or the intermediate stage as will be described in detail later. At the time of re-feeding of the copy paper sheets, the re-feeding roller 38 is brought into pressing contact, at a proper pressure, with the copy paper sheets aligned on the intermediate tray 58.

Figure 4:
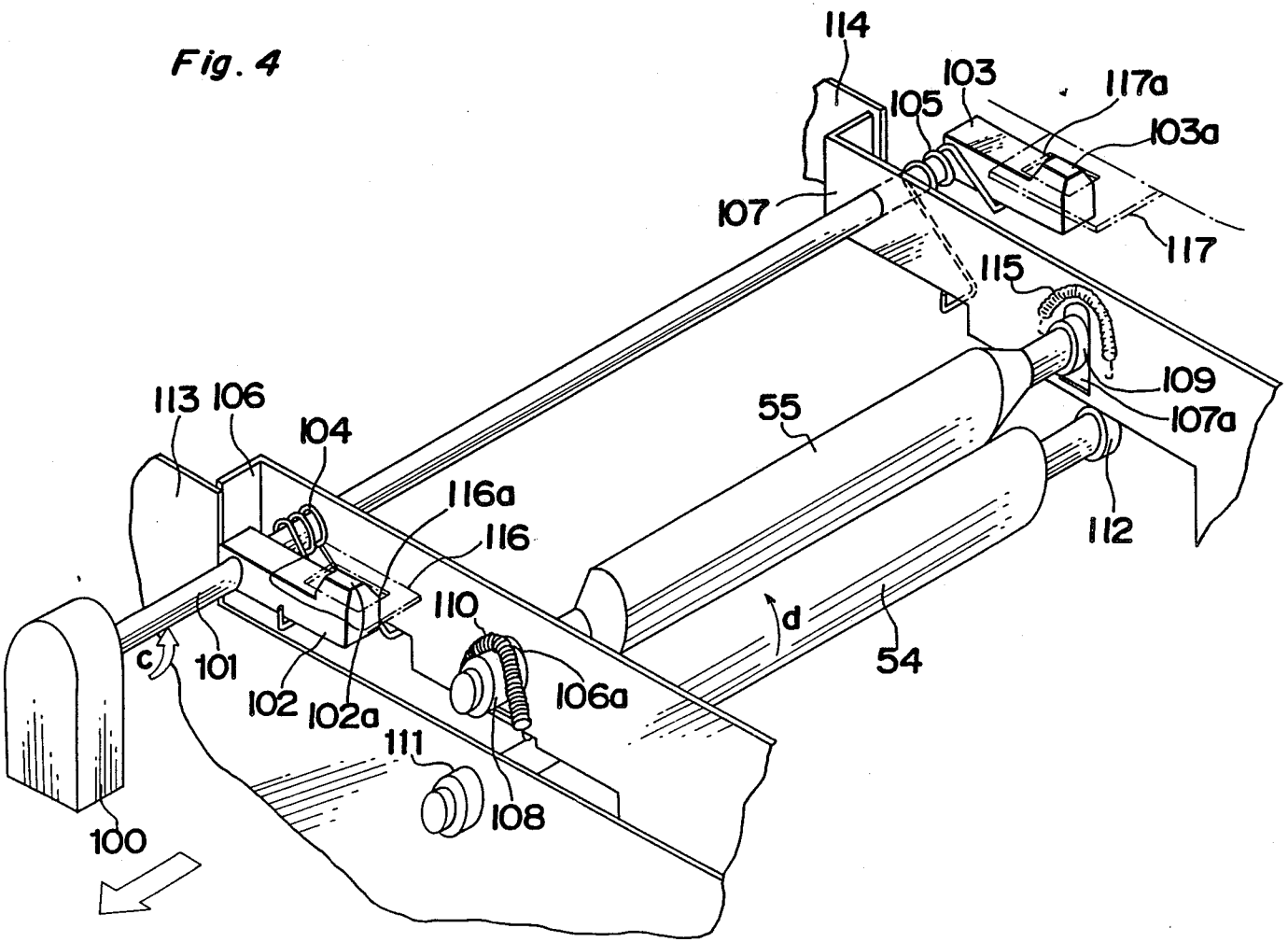
FIG. 4 is an perspective view of a lock mechanism employed in the copying apparatus of FIG. 1.

Hereinbelow, a unit lock mechanism will be described with reference to FIG. 4. The unit lock mechanism not only locks the intermediate tray unit A in the apparatus housing H but also locks the transport block II to the intermediate tray unit A so as to hold the upper transport roller 55 and the lower transport roller 54 in pressing contact with each other. In the unit lock mechanism, a shaft 101 is rotatably fitted through frames 106 and 107 of the transport block II. An operating lever 100 is mounted on one end portion of the shaft 101 adjacent to the frame 106. Furthermore, lock levers 102 and 103 are mounted on the shaft 101 so as to be disposed axially outwardly of the frames 106 and 107, respectively. A torsion spring 104 wound, between the frame 106 and the lock lever 102, around the shaft 101 is engaged, at opposite ends thereof, with the lock lever 102 and the frame 106, respectively. Likewise, a torsion spring 105 wound, between the frame 107 and the lock lever 103, around the shaft 101 is engaged, at opposite ends thereof, with the lock lever 103 and the frame 107, respectively. Accordingly, the shaft 101 is urged together with the operating lever 100 and the lock levers 102 and 103 in the direction of the arrow c by the torsion springs 104 and 105. At this time, protrusions 102*a* and 103*a* of the lock levers 102 and 103 are, respectively, inserted from below into openings 116*a* and 117*a* formed on projecting pieces 116 and 117 of a frame of the apparatus housing H, respectively, whereby the intermediate tray unit A is locked relative to the apparatus housing H and the transport block II is prevented from being pivoted upwardly. As shown in FIG. 4, bent end portions of the frames 106 and 107 are inwardly brought into contact with frames 113 and 114 of the intermediate tray unit A so as to be engaged with the intermediate tray unit A. Meanwhile, as shown in FIG. 3, since the support shaft 95 is coupled with the frames 113 and 114 of the intermediate tray unit A and the frames 106 and 107 of the transport block II, the transport block II can be pivoted upwardly about the support shaft 95.

In order to release locking of the intermediate tray unit A to the apparatus housing H, the operating lever 100 is rotated in the direction opposite to the direction of the arrow c from the state shown in FIG. 4 against an urging force of the torsion springs 104 and 105, so that the lock levers 102 and 103 are disengaged from the openings 116*a* and 117*a* of the projecting pieces 116 and 117, respectively and thus, it becomes possible to draw the intermediate tray unit A out of the apparatus housing H forwardly. At the same time, locking of the transport block II to the intermediate tray unit A is released and therefore, can be pivoted upwardly about the support shaft 95. Meanwhile, it is so arranged that when the transport block II has been pivoted upwardly about the support shaft 95, the transport block II is prevented by a stopper member (not shown) provided on the intermediate tray unit A from being pivoted further from the position shown in the one-dot chain lines of FIG. 3. Namely, the transport block II can be locked to the intermediate tray unit A by the single unit lock mechanism.

Meanwhile, as shown in FIG. 4, the lower transport roller 54 is mounted on the frames 113 and 114 of the intermediate tray unit A through bearings 111 and 112, respectively and is arranged to be driven in the direction of the arrow d by a driving means (not shown). The upper transport roller 55 is provided, at opposite ends thereof, with bearings 108 and 109. Since the bearings 108 and 109 are loosely inserted into guide slots 106*a* and 107*a* formed on the frames 106 and 107 in the vertical direction, the transport roller 55 is vertically movable and rotatable. Coiled springs 110 and 115 are attached to outer faces of the frames 106 and 107, respectively and are engaged with the bearings 108 and 109 from above, respectively so as to urge the transport roller 55 downwardly. Accordingly, when the transport block II is locked to the intermediate tray unit A, the transport roller 55 is brought into pressing contact with the transport roller 54 at a proper predetermined pressure by an urging force of the coiled springs 110 and 115 so as to be driven for rotation thereof upon rotation of the transport roller 54. When the transport block II has been pivoted upwardly after release of locking of the transport block II to the intermediate tray unit A, the bearings 108 and 109 are, respectively, brought into contact with lower edges of the guide slots 106*a* and 107*a* by the urging force of the coiled springs 110 and 115 and thus, the transport roller 55 is brought out of pressing contact with the transport roller 54.

The lower transport roller 54 is mounted on the frames 113 and 114 of the intermediate tray unit A so that a driving force transmission mechanism (not shown) for the transport roller 54 may be driven by a mechanism common to other driving members of the intermediate tray unit A. Hence, in order for the transport roller 55 to be driven by the transport roller 54 it becomes necessary to provide a means for bringing the transport roller 55 into pressing contact with the transport roller 54 at a proper pressure. To this end, the coiled springs 110 and 115 are employed as an elastic urging means and the lock mechanism for securing the transport block II at the predetermined position is provided.

Then, an alignment mechanism for aligning the copy paper sheets 81 transported onto the intermediate tray 58 is described with reference to FIGS. 5 to 8. In FIG. 5, the arrow e indicates a direction of feed of the copy paper sheets 81 onto the intermediate tray 58 at the time of duplex copying. Similarly, the arrow f indicates a direction of feed of the copy paper sheets 81 onto the intermediate tray 58 at the time of composite copying, while the arrow g indicates a re-feeding direction of the copy paper sheets 81.

The copy paper sheets 81 are aligned with each other by the four regulating plates 62, 63, 64 and 65. The side regulating plate 62 is pivotally provided so as to be pivoted about a support shaft 68, while another side regulating plate 63 is movably mounted on a slide rail 72 through a slide member 71. The front regulating plate 64 and the rear regulating plate 65 are movably mounted on the slide rail 77 through the slide members 73 and 79, respectively. When the slide member 71 is driven by a stepping motor (not shown), the side regulating plate 63 is displaced in the directions of the arrows h and h'. Likewise, when the slide members 73 and 79 are driven by stepping motors (not shown), the front and rear regulating plates 64 and 65 are displaced in the directions of the arrows g and g'. Amounts of displacement of the regulating plates 63, 64 and 65 are set to predetermined values by controlling rotational angles of the stepping motors, respectively.

Figure 6:
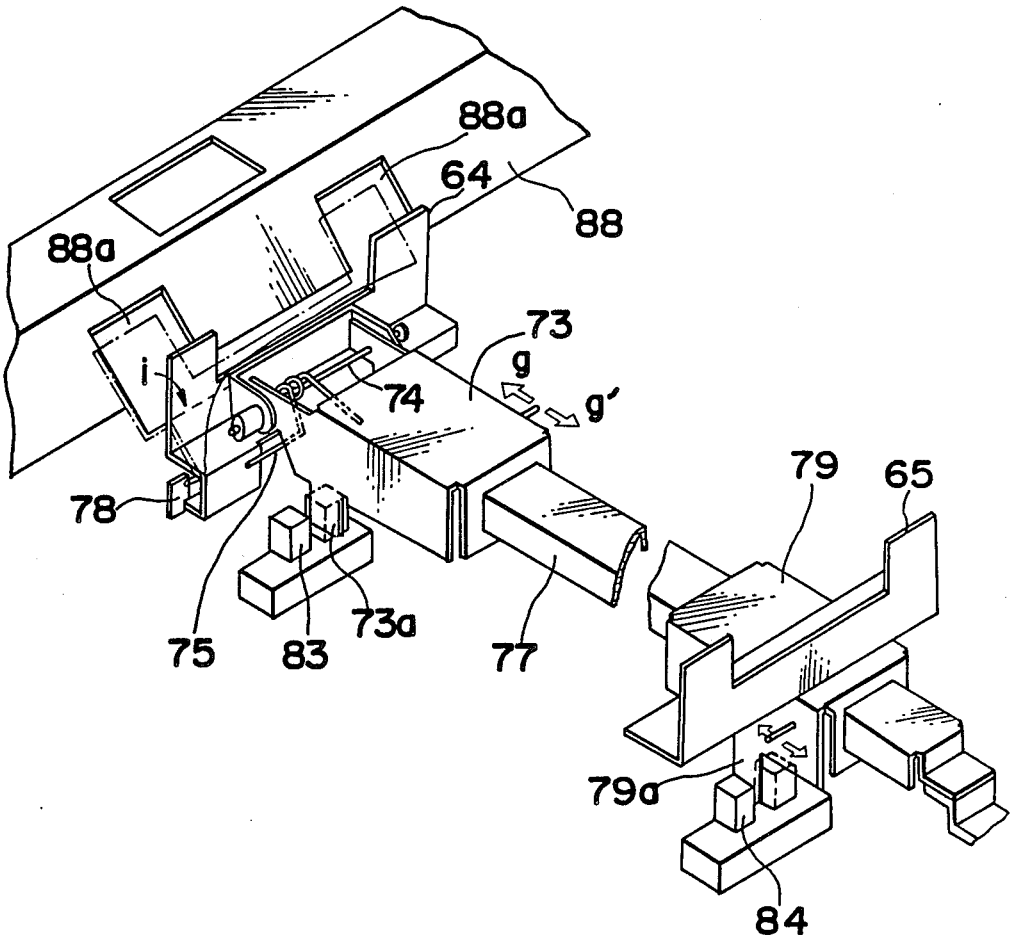
FIG. 6 is a perspective view of a mounting portion for regulating plates employed in the copying apparatus of FIG. 1.
Figure 7:
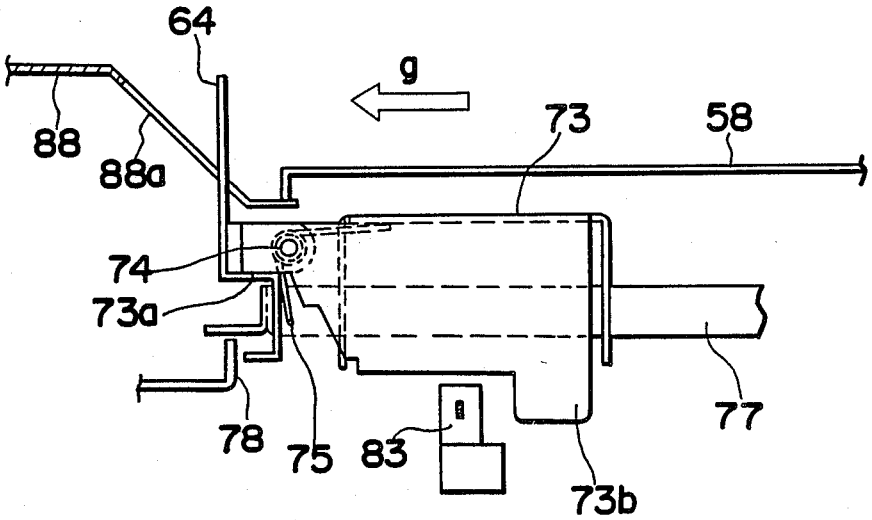
FIGS. 7 and 8 are views explanatory of operations of a front regulating plate employed in the copying apparatus of FIG. 1.

As shown in FIG. 6, the front regulating plate 64 is pivotally mounted on the slide member 73 so as to be pivoted about a support shaft 74 and is urged in the direction of the arrow i by a torsion spring 75 wound around the support shaft 74. The regulating plate 64 is usually so regulated by a lower edge 73*a* of a projection of the slide member 73 as to extend at right angles to the intermediate tray 58 as shown in FIG. 7. This front regulating plate 64 disposed at the position of FIG. 7 aligns leading edges of the copy paper sheets 81 transported onto the intermediate tray 58. At the time of re-feeding of the copy paper sheets 81, the slide member 73 is displaced in the direction of the arrow g, so that the front regulating plate 64 is pivoted, through contact of its lower end with a stopper 78, about the support shaft 74 in the direction of the arrow i' against an urging force of the torsion spring 75 as shown in FIG. 8 so as to be retracted into a pair of recesses 88*a* formed on the guide plate 88 such that re-feeding of the copy paper sheets 81 can be performed.

Figure 8:
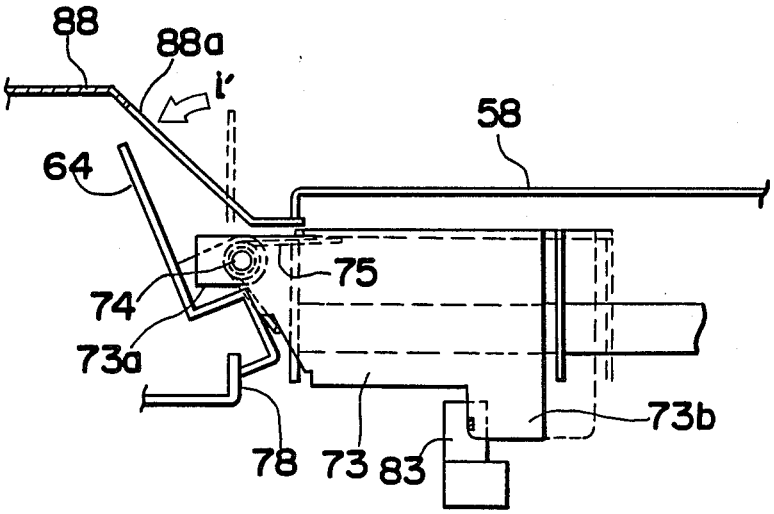

The front regulating plate 64 can be displaced to a re-feeding position shown by the solid lines of FIG. 8, an alignment position (FIG. 7) for aligning the leading edges of the copy paper sheets 81 and a temporary alignment position for composite copying. The temporary alignment position of the front regulating plate 64, which will be explained later, varies according to size of the copy paper sheets 81. Positional control of the front regulating plate 64 is based on detection of a protrusion 73*b* of the slide member 73 by a transmission type photosensor 83 as shown in FIG. 8. Similarly, as shown in FIG. 6, positional control of the rear regulating plate 65 is based on detection of a protrusion 79*a* of the slide member 79 by a transmission type photosensor 84. Positional control of the side regulating plate 63 is likewise based on detection of a fixed position of the slide member 71 by a transmission type photosensor 82 as shown in FIG. 18.

Meanwhile, as shown in FIG. 5, the side regulating plate 62 is coupled with a solenoid 70 and is urged in the direction of the arrow h by a coiled spring 69. Since the solenoid 70 is usually de-energized, the side regulating plate 62 is disposed at the position shown by the dotted lines of FIG. 5 through its contact with a stopper (not shown). At the time of re-feeding of the copy paper sheets, the side regulating plate 62 is brought into contact with a stopper 91 formed on the holder 66 of the re-feeding roller 38 so as to be set at the position shown by the solid lines of FIG. 5. When the solenoid 70 has been energized, the side regulating plate 62 is pivoted about the support shaft 68 to the position shown by the one-dot chain lines of FIG. 5 against an urging force of the coiled spring 69.

Figure 10:
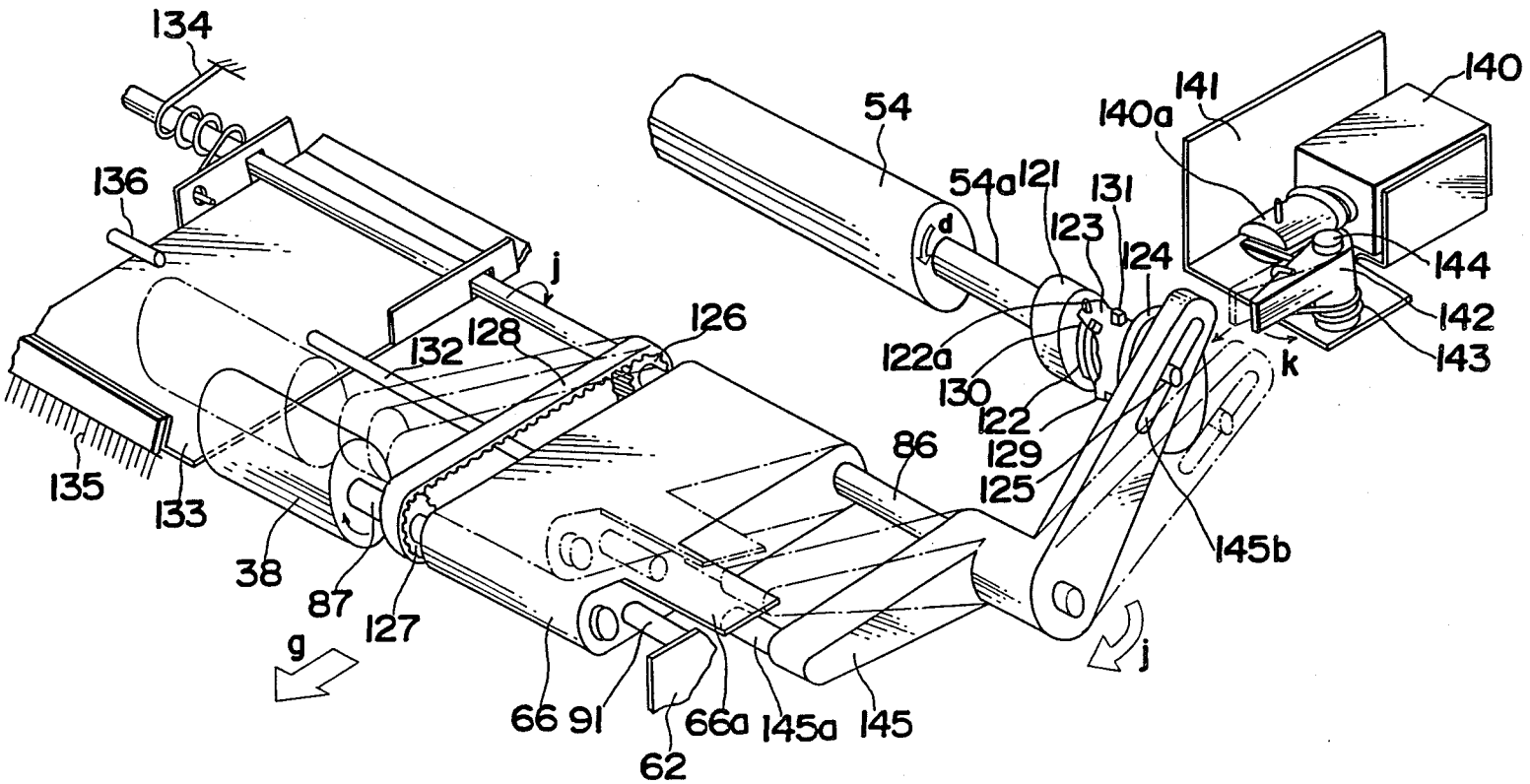
FIG. 10 is a perspective view of a pivotal mechanism for a re-feeding roller of the copying apparatus of FIG. 1.

Then, constructions and operations of a pivotal mechanism for pivoting the re-feeding roller 38 are described with reference to FIGS. 10 to 15. As shown in FIG. 10, the re-feeding roller 38 is supported, at its one end, by a support shaft 87 which is rotatably fitted into the holder 66. The holder 66 is secured, at its rear end, to the support shaft 86 which is rotatably supported by the frames 113 and 114 (FIG. 4) of the intermediate tray unit A. The support shaft 86 is driven for rotation thereof by a driving means (not shown) in the direction of the arrow j. This rotation of the support shaft 86 is transmitted to the re-feeding roller 38 through a timing belt 128 trained over pulleys 126 and 127 which are mounted on the support shafts 86 and 87, respectively. Namely, the support shaft 86 is coupled with a driving means of each transport roller of the intermediate tray unit A by a clutch (not shown). This clutch is actuated only at the time of re-feeding of the copy paper sheets such that the re-feeding roller 38 is driven for rotation thereof in the direction of the arrow j.

Figure 12:
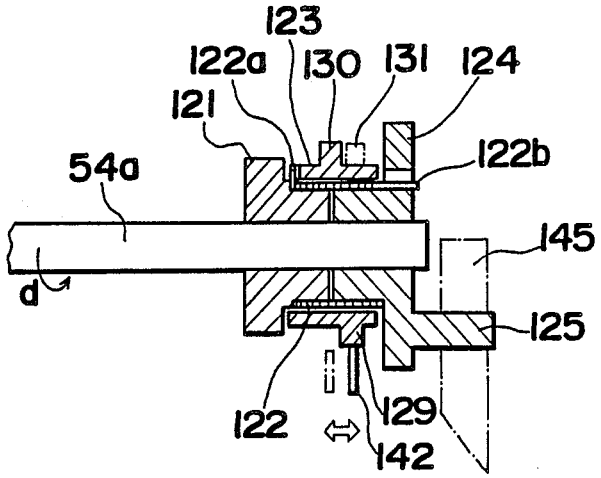
FIG. 12 is a sectional view of a clutch means of the copying apparatus of FIG. 1.

A pivotal lever 145 is pivotally mounted on one end of the support shaft 86. A shaft 145*a* mounted on one end of the pivotal lever 145 confronts a projecting piece 66*a* of the holder 66 from below. Meanwhile, a pin 125 driven into a clutch plate 124 which is rotatably mounted on a support shaft 54*a* of the transport roller 54 is loosely inserted into an elongated opening 145*b* formed on the other end of the pivotal lever 145. As shown in FIG. 12, another clutch plate 121 is secured to one end of the support shaft 54*a*. A kick spring 122 is wound around boss portions of the clutch plates 121 and 124. Furthermore, a collar 123 provided, at its outer periphery, with claw portions 129, 130 and 131 is fitted around the kick spring 122. One end 122*a* and the other end 122*b* of the kick spring 122 are, respectively, engaged with the collar 123 and the clutch plate 124. Namely, the kick spring 122 in its free state clamps the boss portions of the clutch plates 121 and 124 such that rotation of the support shaft 54*a* in the direction of the arrow d is transmitted from the clutch plate 121 to the clutch plate 124 and the collar 123 by the kick spring 122. On the other hand, when rotation of the collar 123 is prevented by a lever 142 described below, rotation in the direction of the arrow d, which is transmitted from the support shaft 54*a* to the clutch plate 121, is so exerted as to rewind the kick spring 122, so that the clutch plate 121 is rotated through slip between the clutch plate 121 and the kick spring 122 and thus, the rotation in the direction of the arrow d is not transmitted to the clutch plate 124.

A means for actuating the above described clutch means is, as shown in FIG. 10, constituted by a solenoid 140 and the lever 142 which are secured to a mounting plate 141. The lever 142 is pivotally mounted on a support shaft 144 and is at all times urged in the direction of the arrow k by an urging force of a torsion spring 143 wound around a lower portion of the lever 142. Furthermore, the lever 142 is regulated by a stopper (not shown) at the position shown by the solid lines of FIG. 10. The lever 142 is coupled with a plunger 140*a* of the solenoid 140. Upon energization of the solenoid 140, the plunger 140*a* is retracted and thus, the lever 142 is pivoted to the position shown by the one-dot chain lines of FIG. 10. A distal end of the lever 142 is disposed on rotational loci of the claw portions 129, 130 and 131 of the collar 123. As shown in FIG. 12, when the lever 142 is set at the position shown by the solid lines, the claw portions 129 and 131 are brought into contact with the lever 142. Meanwhile, when the lever 142 is set at the position shown by the one-dot chain lines, the claw portion 130 is brought into contact with the lever 142.

Here, the upper, intermediate and lower stages of the positions of the re-feeding roller 38 in response to operations of the above described clutch means and the pivotal lever 145 are described sequentially.

Figure 11:
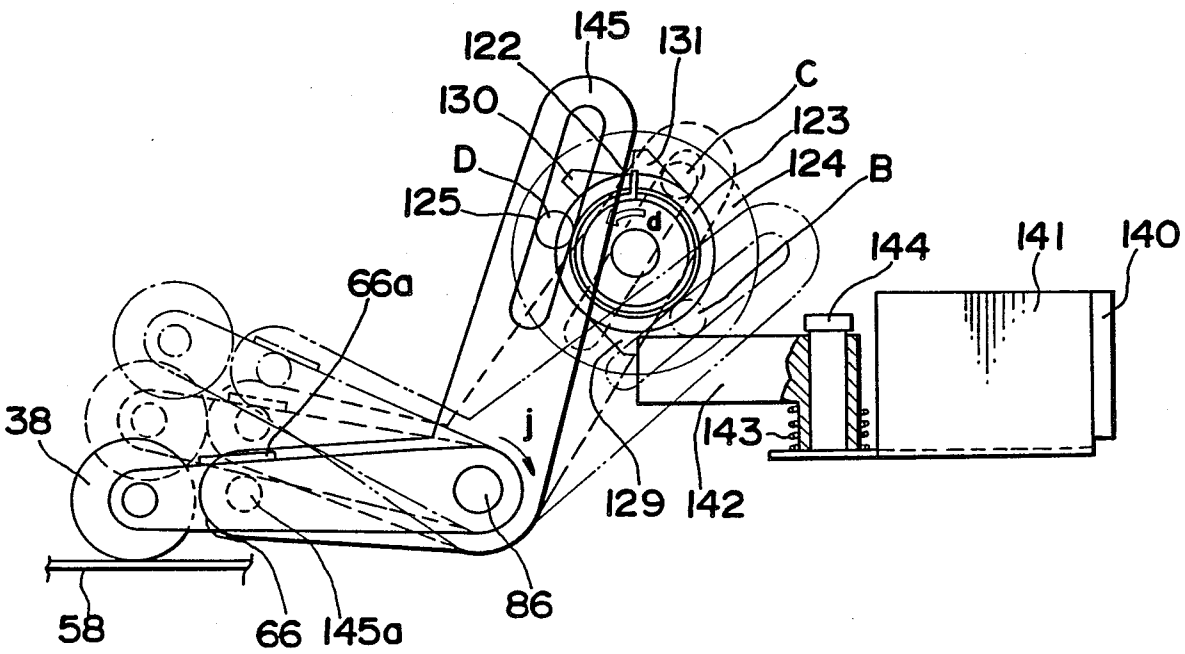
FIG. 11 is a view explanatory of operations of the pivotal mechanism of FIG. 10.

(1) Upper stage (One-dot chain lines in FIG. 11)

Figure 13:
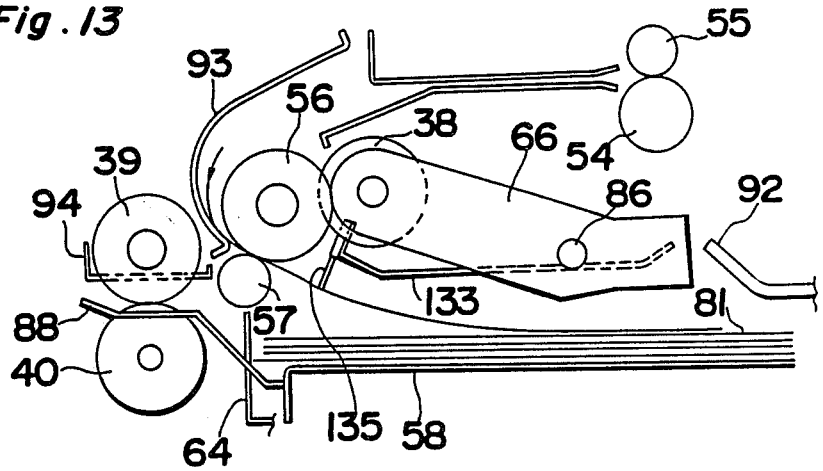
FIGS. 13, 14 and 15 are views explanatory of operations of the re-feeding roller of FIG. 10.

When the re-feeding roller 38 is positioned at the upper stage, the solenoid 140 is de-energized and thus, the claw portion 129 of the collar 123 is held in contact with the lever 142 in the direction of the arrow d. At this time, since the collar 123 is prevented from being rotated, rotation of the transport roller 54 is not transmitted to the clutch plate 124 even if the transport roller 54 is rotated in the direction of the arrow d. Thus, the pivotal lever 145 is held by the pin 125 at the position B shown by the two-dot chain lines in FIG. 11. Furthermore, the holder 66 is lifted by the shaft 145*a* of the pivotal lever 145 so as to be pivoted upwardly about the support shaft 86 such that the re-feeding roller 38 is positioned at the upper stage shown by the one-dot chain lines in FIG. 11. When the copy paper sheets 81 are transported from the turnover block III onto the intermediate tray 58 at the time of duplex copying, the re-feeding roller 38 is set at the upper stage as shown in FIG. 13.

(2) Intermediate stage (Dotted lines in FIG. 11)

Figure 14:
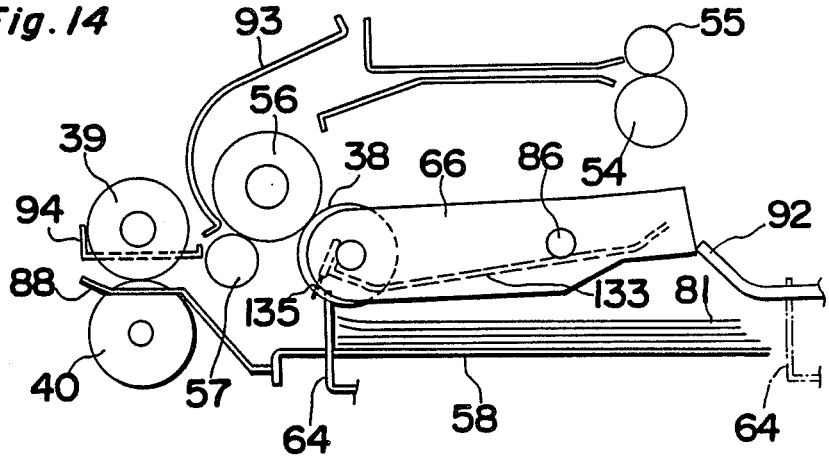

When the solenoid 140 is energized during rotation of the transport roller 54 in the direction of the arrow d, the claw portion 129 is brought out of contact with the lever 142. At this time, the kick spring 122 clamps the boss portions of the clutch plates 121 and 124, so that the clutch plate 124 and the collar 123 are rotated together in the direction of the arrow d. Accordingly, the claw portion 130 is brought into contact with the lever 142, so that the collar 123 is prevented from being rotated and the clutch plate 124 is also prevented from being rotated. Namely, the collar 123 and the clutch plate 124 are rotated in the direction of the arrow d through an angle corresponding to a circumferential distance between the claws 129 and 130. Thus, the pivotal lever 145 is pivoted together with the pin 125 in the direction opposite to the arrow j so as to be held at the position C shown by the dotted lines in FIG. 11. Thus, the holder 66 is also pivoted downwardly in association with the shaft 145*a* and thus, the re-feeding roller 38 is positioned at the intermediate stage shown by the dotted lines in FIG. 11. When the copy paper sheets 81 are transported from the transport rollers 50 and 51 onto the intermediate tray 58 at the time of composite copying, the re-feeding roller 38 is set at the intermediate stage as shown in FIG. 14. Setting of the re-feeding roller 38 and the holder 66 at the intermediate stage is aimed at preventing the copy paper sheets 81 from being ejected out of the intermediate tray 58 through upward curling of the leading edges of the copy paper sheets 81 when the copy paper sheets 81 aligned on the intermediate tray 58 are conveyed to the re-feeding position.

(3) Lower stage (Solid lines in FIG. 11)

Figure 15:
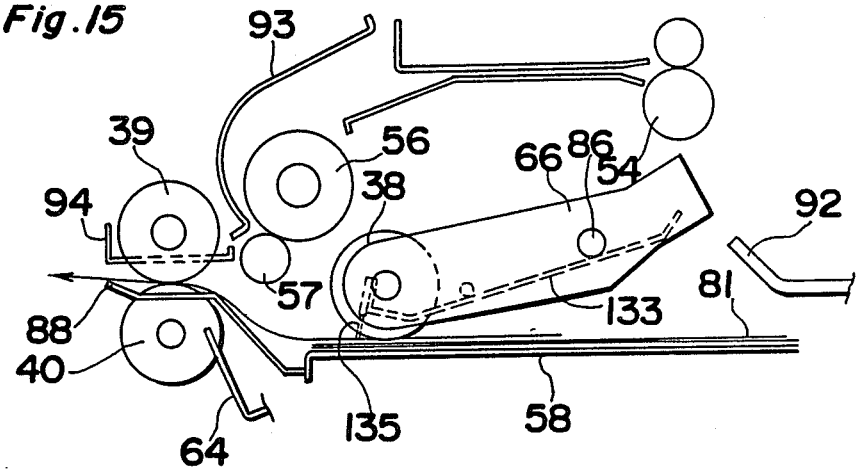

In the case where the solenoid 140 is de-energized when the re-feeding roller 38 is positioned at the intermediate stage, the claw portion 130 is brought out of contact with the lever 142. At this time, the clutch plate 124 and the collar 123 are rotated together in the direction of the arrow d through a clamping force of the kick spring 122 until the claw portion 131 is brought into contact with the lever 142. Thus, the pivotal lever 145 is pivoted together with the pin 125 in the direction opposite to the arrow j so as to be held at the position D shown by the solid lines in FIG. 11. At this time, the shaft 145*a* of the pivotal lever 145 is disposed below a projecting piece 66*a* of the holder 66 and thus, the re-feeding roller 38 is brought into pressing contact with the intermediate tray 58 by its own weight. Setting of the re-feeding roller 38 at the lower stage is performed when the copy paper sheets 81 aligned on the intermediate tray 58 are re-fed. At this time, the refeeding roller 38 is brought into pressing contact, by its own weight, with the copy paper sheets 81 aligned on the intermediate tray 58 and re-feed the copy paper sheets 81 one sheet by one sheet upon its rotation in the direction of the arrow j as shown in FIG. 15. Namely, a pressure required for re-feeding the copy paper sheets 81 is obtained by the own weight of the re-feeding roller 38. However, if necessary, it can also be so arranged that a spring or the like for urging the re-feeding roller 38 downwardly is provided so as to impart to the re-feeding roller 38 the pressure required for re-feeding the copy paper sheets 81.

Here, alignment operations of the copy paper sheets 81 on the intermediate tray 58 are described with reference to FIGS. 16 to 27.

(1) Alignment at the time of duplex copying:

(a) Initially, the copy paper sheets 81 of size necessary for copying are selected, by using the operating panel (not shown), from the copy paper sheets 81 stored in the storage portions 42 and 43.

(b) The copying mode of the copying apparatus K is set to the duplex copying mode. Then, the changeover levers 41 and 59 (FIG. 1) are changed over to the positions shown by the solid lines in FIG. 1. The regulating plates 63, 64 and 65 are displaced by the stepping motors to the positions shown by the solid lines in FIGS. 16 to 18 so as to be placed in a waiting state. In this waiting state, an area enclosed by the regulating plates 62 to 65 is slightly larger than the size of the selected copy paper sheets 81. Namely, the front regulating plate 64 deviates slightly in the re-feeding direction of the arrow g from a point of contact between the turnover transport rollers 56 and 57. This is aimed at preventing trailing edges of the copy paper sheets 81 transported onto the intermediate tray 58 by the turnover transport rollers 56 and 57 from riding over the front regulating plate 64 upon their release from the point of contact between the turnover transport rollers 56 and 57. In the waiting state, the rear regulating plate 65 is spaced a distance B from the front regulating plate 64. The distance B is so set as to be slightly larger than the size of the selected copy paper sheets 81. As shown in FIG. 16, the side regulating plate 63 is disposed slightly outwardly of a transport reference position X2 in the waiting state. The side regulating plate 63 is retracted from the transport reference position X2 in the waiting state to allow for receipt of obliquely fed copy paper sheets. This is necessary since there is a possibility that a variation in transport speed of the copy paper sheets 81 may be produced in a widthwise direction of the copy paper sheets 81 due to variations in the outside diameter or contact pressure of each transport roller in its axial direction. Meanwhile, the side regulating plate 62 is depressed in the direction of the arrow h by the coiled spring 69 upon de-energization of the solenoid 70 and thus, is pivoted to the position shown by the solid lines in FIG. 18 in the waiting state. On the other hand, the re-feeding roller 38 is set at the upper stage shown in FIG. 13 so as to be retracted away from the intermediate tray 58 such that transport of the copy paper sheets 81 from the turnover transport rollers 56 and 57 onto the intermediate tray 58 is not prevented.

(c) Then, the number of copies to be taken is set. It is noted that the steps (a), (b) and (c) can be carried out at random.

(d) A print switch is turned on.

1. Each of the copy paper sheets fed from the storage portion 42 or 43 is subjected, on one face thereof, to copying in accordance with the above described copying steps and then, is transported in the direction of the arrow e of FIG. 17 by the transport block II. After a detection sensor 60 has been turned on, the copy paper sheets are turned over by the turnover transport rollers 56 and 57 so as to be conveyed onto the intermediate tray 58 such that the copied face of each of the copy paper sheets is directed upwardly.

2. In response to an ON signal of the detection sensor 60, the solenoid 70 is energized upon actuation of a delay timer immediately before the leading edge of each of the copy paper sheets reaches the intermediate tray 58. Meanwhile, the side regulating plate 62 is pivoted slightly outwardly in the direction of the arrow h' from a transport reference position X1. The side regulating plate 62 is retracted slightly outwardly from the transport reference position X1 because oblique transport of the copy paper sheets may take place as described above.

3. When the trailing edge of each of the copy paper sheets 81 has been fully transported onto the intermediate tray 58, the solenoid 70 is de-energized and thus, the side regulating plate 62 is pivoted by the urging force of the coiled spring 69 (FIG. 5) to the position shown by the solid lines in FIGS. 16 and 18. At this time, the copy paper sheets 81 transported onto the intermediate tray 58 are preliminarily aligned with each other in contact with the side regulating plate 63.

Figure 24:
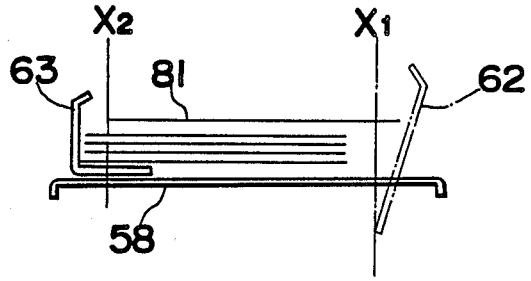
FIGS. 24 to 27 are views explanatory of alignment operations of the copy paper sheets in the copying apparatus of FIG. 1.
Figure 25:
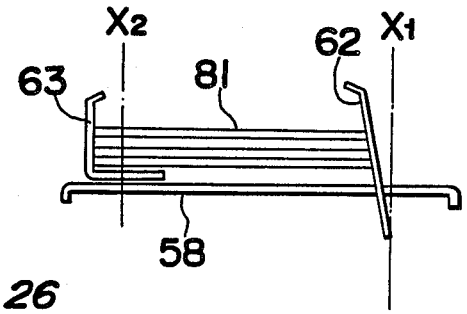

4. The above described steps 1 to 3 are repeated until the copy paper sheets 81 of the number of copies to be taken are transported onto the intermediate tray 58. Each time one of the copy paper sheets 81 is transported onto the intermediate tray 58, the side regulating plate 62 is pivoted such that the copy paper sheets 81 are aligned with each other by the other side regulating plate 63 as shown in FIGS. 24 and 25. This alignment is a preliminary operation for ensuring final alignment performed later.

5. When the copy paper sheets 81 of the number of copies to be taken have been transported onto the intermediate tray 58, the solenoid 70 is energized and thus, the side regulating plate 62 is pivoted outwardly to the position shown by the one-dot chain lines in FIGS. 16 and 18.

Figure 26:
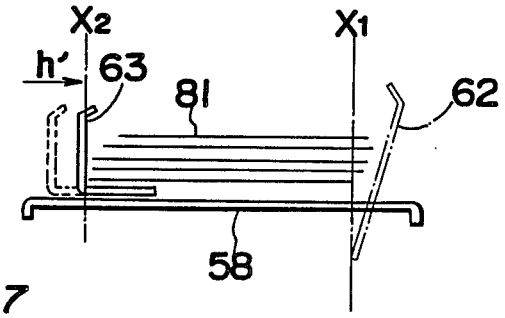

6. In this state, the copy paper sheets 81 deviate from the widthwise transport reference positions X1 and X2 and thus, the side regulating plate 63 is displaced to the transport reference position X2 as shown in FIG. 26. A travel speed of the side regulating plate 63 at this time is preferably set at about 30 mm/sec. or less.

7. At this time, several upper ones of the copy paper sheets 81 deviate in the direction of the arrow h' from the transport reference position X1 due to the inertia force as shown in FIG. 26. In order to align these copy paper sheets with the remaining copy paper sheets, energization and de-energization of the solenoid 70 are repeated several times so as to pivot the side regulating plate 62 several times such that the copy paper sheets 81 are completely aligned with each other. When this step 7 proceeds to the next step 8, the solenoid 70 is held in the energization state.

Figure 22:
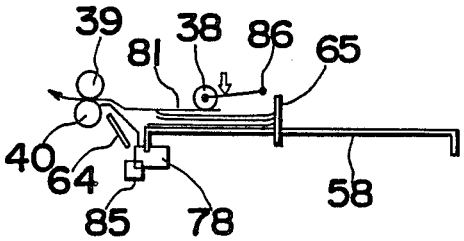
FIG. 22 is a front elevational view of FIG. 21.

8. The solenoid 140 (FIG. 11) is energized twice so as to set the re-feeding roller 38 at the lower stage such that the re-feeding roller 38 is brought into pressing contact, by its own weight, with the copy paper sheets 81 as shown in FIGS. 15 and 22.

Figure 23:
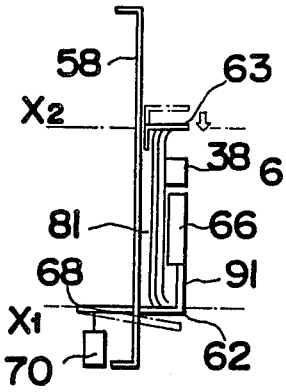
FIG. 23 is a side elevational view of FIG. 21.
Figure 21:
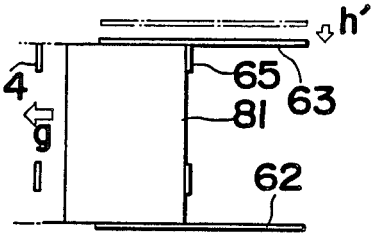
FIG. 21 is a top plan view of the alignment mechanism at the time of re-feeding of copy paper sheets.
Figure 27:
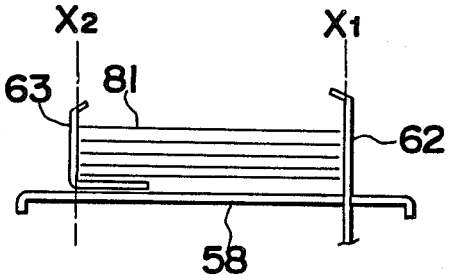

9. Subsequently, the solenoid 70 is de-energized. Thus, the side regulating plate 62 is pivoted inwardly by the urging force of the coiled spring 69 but is brought into contact with the stopper 91 (FIG. 10) formed on the holder 66. Hence, the side regulating plate 62 is set vertically at the transport reference position X1 as shown in FIGS. 23 and 27 such that the copy paper sheets 81 are prevented from being transported obliquely at the time of re-feeding of the copy paper sheets 81.

10. At the same time, the slide member 73 is displaced to the position shown in FIG. 8, so that the front regulating plate 64 is pivoted about the support shaft 74 in the direction of the arrow i' so as to be retracted into the recesses 88*a* of the guide plate 88 such that re-feeding of the copy paper sheets 81 is not prevented by the front regulating plate 64.

11. When the above described operations have been performed, a display indicating that duplex copying can be performed is made on the operating panel of the apparatus housing H. Meanwhile, the changeover lever 41 is changed over to the position shown by the one-dot chain lines in FIG. 1.

(e) The print switch is turned on.

1. A main motor (not shown) is started so as to drive the transport rollers, etc. in the apparatus housing H.

2. A clutch (not shown) for the shaft 86 (FIG. 10) is actuated such that the re-feeding roller 38 is driven for rotation thereof in the direction of the arrow j.

3. Since a coefficient of friction between the re-feeding roller 38 and the copy paper sheets 81 is larger than that among the copy paper sheets 81, an uppermost one of the copy paper sheets 81 is re-fed and the re-fed copy paper sheets 81 are separated into a single sheet by the separating rollers 39 and 40.

4. Thereafter, the copy paper sheets 81 each having one copied face are transported to the timing rollers 13 by the transport rollers 32, 33 and 34. Then, the toner image is transferred onto the other face of each of the copy paper sheets 81. After the toner image on each of the copy paper sheets 81 has been fixed by the fixing device 9, the copy paper sheets 81 are guided to the discharge rollers 15 by the changeover lever 41 so as to be ejected onto the tray 36. Meanwhile, it can be also so arranged that the above described steps 1 to 4 are performed automatically upon completion of alignment of the copy paper sheets 81 without turning on the print switch.

(2) Alignment at the time of composite copying:

(a) The size of the copy paper sheets is selected in the same manner as the above described step (1)-(a).

(b) The copying mode is set to the composite copying mode. The changeover lever 41 is changed over to the position shown by the solid lines in FIG. 1 and changeover lever 59 is changed over to the position shown by the one-dot chain lines in FIG 1. The regulating plates 64 and 65 are displaced by the stepping motors to the positions shown by the solid lines in FIGS. 19 and 20 so as to be placed in the waiting state. In the waiting state, the rear regulating plate 65 deviates from the point of contact between the transport rollers 50 and 51 in the direction opposite to the re-feeding direction of the arrow g. This is aimed at preventing the trailing edge of each of the copy paper sheets 81 transported onto the intermediate tray 58 from riding over the rear regulating plate 65 upon its release from the point of contact between the transport rollers 50 and 51. In the waiting state, the front regulating plate 64 is spaced the distance B from the rear regulating plate 65. The distance B is slightly larger than the size of the selected copy paper sheets. Meanwhile, the side regulating plate 62 is depressed in the direction of the arrow h by the coiled spring 69 upon de-energization of the solenoid 70 so as to be pivoted in the waiting state to the position shown by the solid lines in FIG. 18. On the other hand, the re-feeding roller 38 is set at the intermediate stage shown in FIG. 14 so as to be disposed at a retracted position such that transport of the copy paper sheets 81 on the intermediate tray 58 to be described below is not prevented.

(c) Subsequently, the number of copies to be taken is set. In the same manner as the procedure (1), the above described steps (a), (b) and (c) can also be performed at random.

(d) The print switch is turned on.

1. The copy paper sheets each having one face subjected to a first copying operation are transported in the direction of the arrow f in FIG. 20 so as to turn on a detection sensor 61 and then, are transported onto the intermediate tray 58 such that the one copied face of each of the copy paper sheets is directed downwardly.

2. In response to an ON signal of the detection sensor 61, the solenoid 70 is energized upon actuation of a delay timer immediately before the leading edge of each of the copy paper sheets 81 reaches the intermediate tray 58 and thus, the side regulating plate 62 is pivoted in the direction of the arrow h' slightly outwardly from the transport reference position X1.

3. When the trailing edge of each of the copy paper sheets 81 has been completely transported onto the intermediate tray 58, the solenoid 70 is de-energized and thus, the side regulating plate 62 is pivoted by the urging force of the coiled spring 69 (FIG. 5) to the position shown by the solid lines in FIG. 19. At this time, the copy paper sheets 81 transported onto the intermediate tray 58 are preliminarily aligned with each other in contact with the other side regulating plate 63.

4. Subsequently, the above described steps 1, 2 and 3 are repeated until the copy paper sheets 81 of the number of copies to be taken are transported onto the intermediate tray 58. Each time one of the copy paper sheets 81 is transported onto the intermediate tray 58, the side regulating plate 62 is pivoted such that the copy paper sheets 81 are preliminarily aligned with each other by the other regulating plate 63 as shown in FIGS. 24 and 25. This alignment is a preliminary operation for ensuring final alignment performed later.

5. When the copy paper sheets 81 of the number of copies to be taken have been transported onto the intermediate tray 58, the stepping motors are started so as to displace the regulating plates 64 and 65 to the re-feeding position forwardly in the direction of the arrow g, with the regulating plates 64 and 65 being spaced the distance B. Thus, the copy paper sheets 81 are transported on the intermediate tray 58 to the re-feeding position.

6. Then, the solenoid 70 is energized so as to outwardly pivot the regulating plate 62 to the position shown by the one-dot chain lines of FIG. 18.

7. In this state, since the copy paper sheets 81 deviate from the widthwise transport reference positions X1 and X2, the side regulating plate 62 is displaced to the transport reference position X2 as shown in FIG. 26. A travel speed of the side regulating plate 63 at this time is preferably set at about 30 mm/sec. or less.

8. At this time, several upper ones of the copy paper sheets 81 deviate in the direction of the arrow h' of FIG. 26 due to the inertia force as described earlier. In order to align these copy paper sheets with the remaining copy paper sheets, energization and de-energization of the solenoid 70 are repeated several times so as to pivot the side regulating plate 62 several times such that the copy paper sheets 81 are completely aligned with each other. When this step 8 proceeds to the next step 9, the solenoid 70 is held in the energization state.

9. The solenoid 140 (FIG. 10) is energized once so as to position the re-feeding roller 38 at the lower stage such that the re-feeding roller 38 is brought into pressing contact, by its own weight, with the copy paper sheets 81 as shown in FIGS. 15 and 22.

10. Then, the solenoid 70 is de-energized as in the above described step (1)-(d)-9. Thus, the side regulating plate 62 is brought into contact with the stopper 91 of the holder 66 so as to be vertically set at the transport reference position X1 as shown in FIGS. 23 and 27.

11. At the same time, the front regulating plate 64 is retracted into the recesses 88*a* of the guide plate 88 in the same manner as in the above described step (1)-(d)-10.

12. When the above described steps have been carried out, a display indicating that composite copying can be performed is made. Meanwhile, the changeover lever 41 is changed over to the position shown by the one-dot chain lines in FIG. 1.

(e) The print switch is turned on. The above described steps (1)-(e)-l, 2, 3 and 4 are carried out such that composite copying performed on the copied face of each of the copy paper sheets. Meanwhile, as described earlier, it can also be so arranged that the steps (1)-(e)-l, 2, 3 and 4 are carried out automatically upon completion of alignment of the copy paper sheets without turning on the print switch. In the alignment method referred to above, the copy paper sheets are preliminarily aligned with each other at the position deviating in the widthwise direction from the transport reference positions X1 and X2 each time one of the copy paper sheets is transported onto the intermediate tray 58. Then, after the copy paper sheets 81 of the number of copies to be taken have been transported onto the intermediate tray 58, the copy paper sheets 81 are displaced to the transport reference positions X1 and X2 so as to be aligned with each other again. Accordingly, the copy paper sheets 81 can be aligned with each other positively and accurately and thus, improper re-feeding of the copy paper sheets 81 can be eliminated. Meanwhile, if a friction member made of rubber, etc. is provided on a bottom portion of the side regulating plate 63, inaccurate positioning of the copy paper sheets 81 transported onto the intermediate tray 58 can be obviated, thereby resulting in more positive alignment of the copy paper sheets 81.

Then, a charge erasing mechanism of the copying apparatus K is described with reference to FIGS. 28 to 30. Since the copy paper sheets 81 transported into the intermediate tray unit A are heated through electric discharge of the charge eraser 5*b* or at the time the toner image on each of the copy paper sheets 81 is fixed by the fixing device 9 prior to alignment of the copy paper sheets 81, a certain amount of water content of the copy paper sheets 81 is evaporated from the copy paper sheets 81 and thus, the copy paper sheets 81 are in a state susceptible to electrical charging. Especially, at the time of duplex copying, since a feed distance of the copy paper sheets 81 becomes longer due to passage of the copy paper sheets 81 through the transport block II, the copy paper sheets 81 are electrically charged as a matter of fact. The electrically charged copy paper sheets 81 apply an attractive force to each other, thus resulting in such inconveniences that a number of the copy paper sheets 81 are re-fed at a time and the copy paper sheets 81 are transported obliquely. Thus, the charge erasing mechanism for subjecting the copy paper sheets 81 to charge erasing is provided in the intermediate tray unit A. It is preferable that charge erasing of the copy paper sheets 81 is performed immediately before the copy paper sheets 81 are transported onto the intermediate tray 58. If charge erasing is performed prior to a point of time immediately before the copy paper sheets 81 are transported onto the intermediate tray 58, for example, when the copy paper sheets 81 are transported into the intermediate tray unit A, the copy paper sheets 81 are electrically charged when passing through the transport rollers 52, 53, 54, 55, etc. Furthermore, since the copy paper sheets 81 are electrically charged at the time of re-feeding of the copy paper sheets 81 due to friction among the copy paper sheets 81 being re-fed, charge erasing of the copy paper sheets 81 is required to be performed also at the time of re-feeding of the copy paper sheets 81.

More specifically, as shown in FIG. 10, a guide plate 133 having a charge erasing brush 135 provided at a distal end thereof is rotatably mounted on the support shaft 86 and is at all times urged upwardly by a torsion spring 134 wound around the support shaft 86. The guide plate 133 is positioned by a stopper 136 mounted on the frame 114 of the intermediate tray unit A. Meanwhile, a retainer member 132 is formed on the holder 66 so as to extend above the guide plate 133. In response to downward pivotal movement of the re-feeding roller 38 and the holder 66, the guide plate 133 is depressed downwardly by the retainer member 132 so as to be pivoted downwardly about the support shaft 86.

Figure 28:
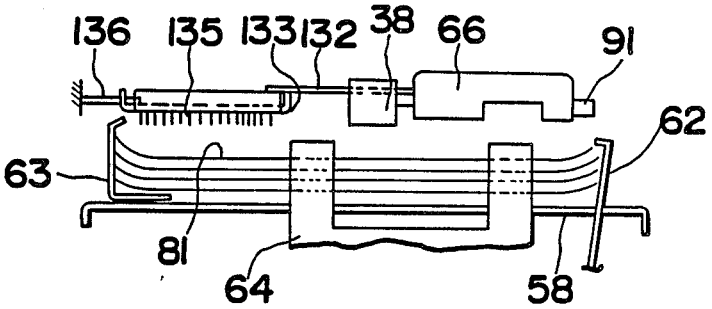
FIGS. 28 to 30 are views explanatory of operations of the re-feeding roller and a charge erasing brush of the copying apparatus of FIG. 1.

FIG. 28 shows a state in which the re-feeding roller 38 is set at the upper stage, namely a state in which the copy paper sheets 81 are transported onto the intermediate tray 58 at the time of duplex copying. At this time, the guide plate 133 is regulated in position by the stopper 136 so as to be set at the upper stage in the same manner as the re-feeding roller 38. Then, each of the copy paper sheets 81 is transported, in contact with the charge erasing brush 135, from the transport rollers 56 and 57 onto the intermediate tray 58 so as to be subjected to charge erasing as shown in FIG. 13.

Figure 29:
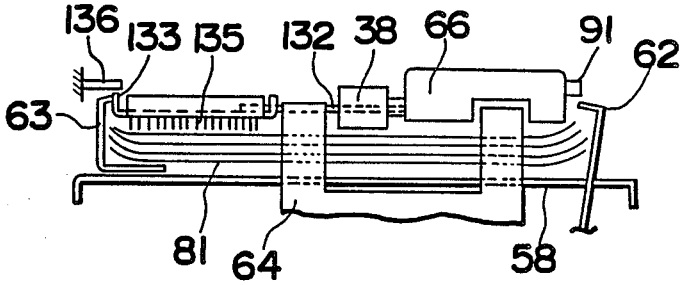

FIG. 29 shows a state in which the re-feeding roller 38 is set at the intermediate stage, namely a state in which the copy paper sheets 81 are transported onto the intermediate tray 58 at the time of composite copying. At this time, the guide plate 133 is depressed by the retainer member 132 formed on the holder 66 so as to be set at the intermediate stage in the same manner as the re-feeding roller 38 as shown in FIG. 14. At this time, the guide plate 133 functions as a guide of the copy paper sheets 81 in the same manner as the holder 66 and the re-feeding roller 38 as will be described later.

Figure 30:
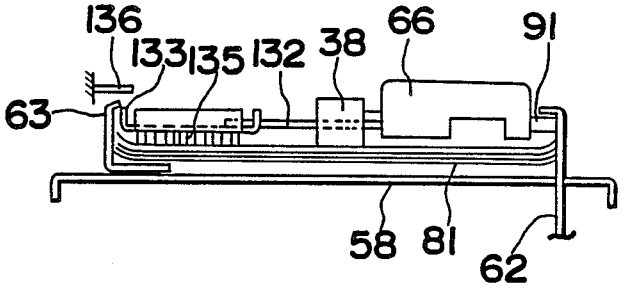

FIG. 30 shows a state in which the re-feeding roller 38 is set at the lower stage, namely a state in which the copy paper sheets 81 are re-fed. At this time, the guide plate 133 is depressed by the retainer member 132 so as to be set at the lower stage in the same manner as the re-feeding roller 38. Each of the copy paper sheets 81 is re-fed in contact with the charge erasing brush 135 so as to be subjected to charge erasing as shown in FIG. 15.

Figure 31:
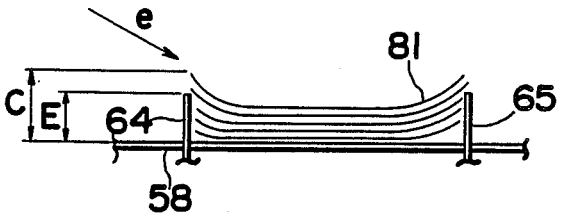
FIGS. 31 to 33 are front elevational views of a copy paper guide mechanism of the copying apparatus of FIG. 1.
Figure 32:
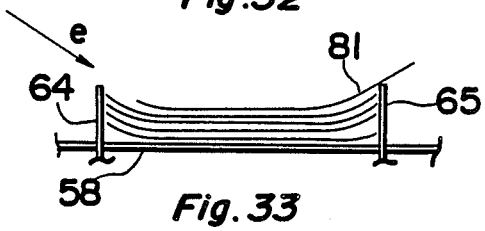
Figure 33:
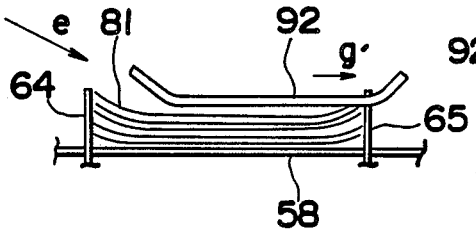
Figure 34:
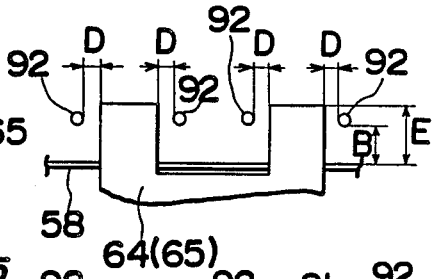
FIGS. 34 to 36 are side elevational views of the copy paper guide mechanism of FIGS. 31 to 33.
Figure 35:
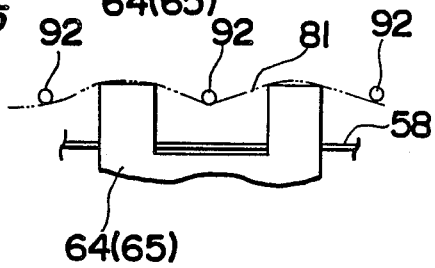

Then, a guide mechanism for guiding the copy paper sheets 81 is described with reference to FIGS. 31 to 36. After the toner image on each of the copy paper sheets 81 has been fixed by the fixing device 9, the copy paper sheets 81 may be readily curled by heat generated at the time of fixing of the toner image on each of the copy paper sheets 81. In the case where a number of the upwardly curled copy paper sheets 81 are transported onto the intermediate tray 58, a height C of the copy paper sheets 81 stacked on the intermediate tray 58 becomes higher than a height E of the regulating plates 64 and 65 as shown in FIG. 31. If the next copy paper sheet 81 is further fed onto the intermediate tray 58 in this state, the copy paper sheet 81 will ride over the regulating plate 65 as shown in FIG. 32. Such an undesirable phenomenon can be eliminated by making the height of the regulating plate 65 larger. However, in this case, the intermediate tray unit A becomes larger in height unpreferably. Accordingly, in the copying apparatus K, guide members 92 are provided above the intermediate tray 58 so as to extend in the direction intersecting with the direction connecting the regulating plates 64 and 65 as shown in FIGS. 33 and 34. In this case, a height B of the guide members 92 is smaller than the height E of the regulating plates 64 and 65 and a distance D between the guide members 92 and the regulating plates 64 and 65 is set at a relatively small value. By this arrangement, it becomes possible to positively prevent the copy paper sheets 81 from riding over the regulating plates 64 and 65. The distance D is set at the small value because such a problem arises if the distance D is set at a large value that the copy paper sheet 81 is deformed as shown by the two-dot chain lines in FIG. 35 so as to ride over the regulating plates 64 and 65.

Meanwhile, FIG. 33 shows positions of the regulating plates 64 and 65 at the time of duplex copying. At the time of composite copying, the regulating plates 64 and 65 are displaced in the direction of the arrow g' from the positions shown in FIG. 33, so that the regulating plate 64 intersects with the guide member 92 and thus, the leading edge of the copy paper sheet 81 transported onto the intermediate tray 58 is prevented from riding over the regulating plate 64.

On the other hand, in the case where the copy paper sheets 81 of a long dimension are transported onto the intermediate tray 58 at the time of composite copying as shown in FIG. 14, the front regulating plate 64 is disposed forwardly of the guide member 92 and thus, the leading edge of the upwardly curled copy paper sheet 81 cannot be guided by the guide member 92. Therefore, the re-feeding roller 38, the holder 66 and the guide plate 133 are set at the intermediate stage so as to guide the leading edge of the copy paper sheet 81 as described above such that the leading edge of the copy paper sheet 81 is prevented from riding over the front regulating plate 64.

Meanwhile, if the guide member 92 is extended to the re-feeding roller 38, it becomes unnecessary to provide a guide constituted by the holder 66, etc. However, if the guide member 92 is extended excessively in the re-feeding direction of the copy paper sheet 81, such a disadvantage is incurred that the copy paper sheet 81 transported from the transport rollers 56 and 57 at the time of duplex copying comes into contact with the guide member 92. The guide member 92 is mounted on the frames 106 and 107 of the transport block II and is lifted upwardly when the transport block II is pivoted upwardly. When the transport block II is pivoted upwardly, such a requirement should be satisfied that the guide member 92 does not interfere with the transport roller 54 provided on the frames 113 and 114 of the intermediate tray unit A. Hence, it is impossible to extend the guide member 92 in the re-feeding direction of the arrow g from the position shown in FIG. 14.

Figure 36:
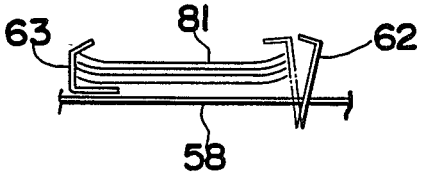

Furthermore, in order to deal with the copy paper sheet 81 curled in the direction perpendicular to the transport direction of the copy paper sheet 81, upper portions of the side regulating plates 62 and 63 are bent inwardly as shown in FIG. 36 such that the curled copy paper sheet 81 is prevented from riding over the side regulating plates 62 and 63.

Meanwhile, the guide plate 133 has a function of preventing opposite lengthwise side portions of the copy paper sheet 81 from deviating upwardly at the time of re-feeding of the copy paper sheet 81. Namely, in this embodiment, since the the re-feeding roller 38 depresses the central portion of the copy paper sheet 81, the opposite lengthwise side portions of the copy paper sheet 81 curled in the widthwise direction deviate upwardly. If the copy paper sheet 81 is re-fed in this state, oblique transport or jamming of the copy paper sheet 81 takes place. In the copying apparatus K, in order to obviate such a problem, not only the re-feeding roller 38 and the holder 66 but the guide plate 133 are disposed at the lower stage at the time of re-feeding of the copy paper sheet 81 such that the holder 66 and the guide plate 133 guide the opposite lengthwise side portions of the copy paper sheet 81 from above, respectively as shown in FIG. 30.

Figure 37:
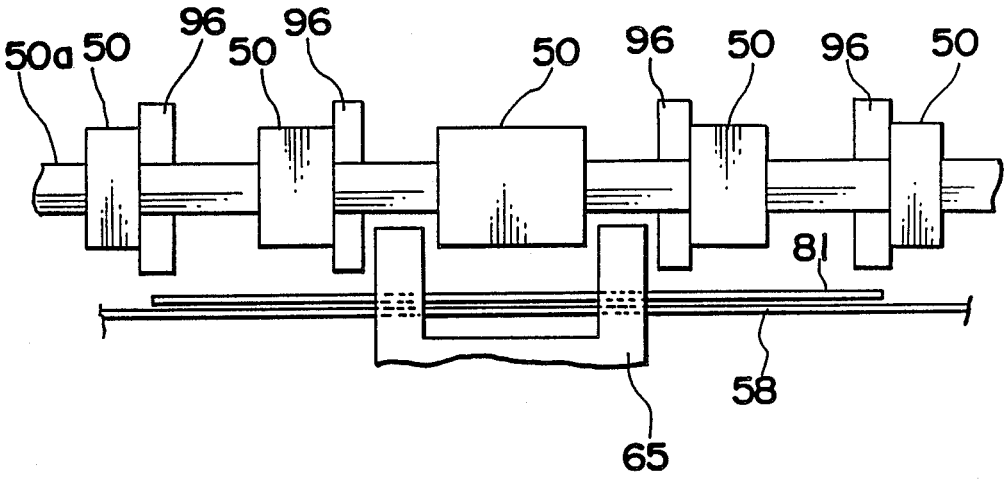
FIG. 37 is a side elevational view of a copy paper transport portion of the copying apparatus at the time of composite copying.
Figure 38:
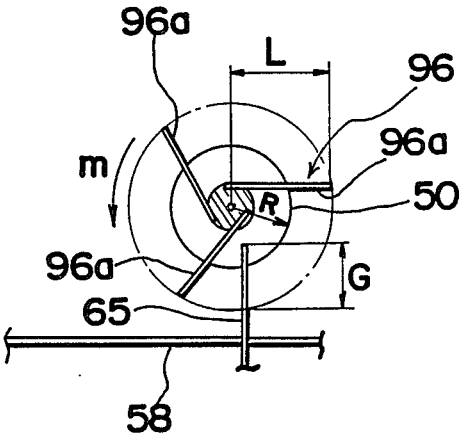
FIG. 38 is a sectional view of FIG. 37.
Figure 39:
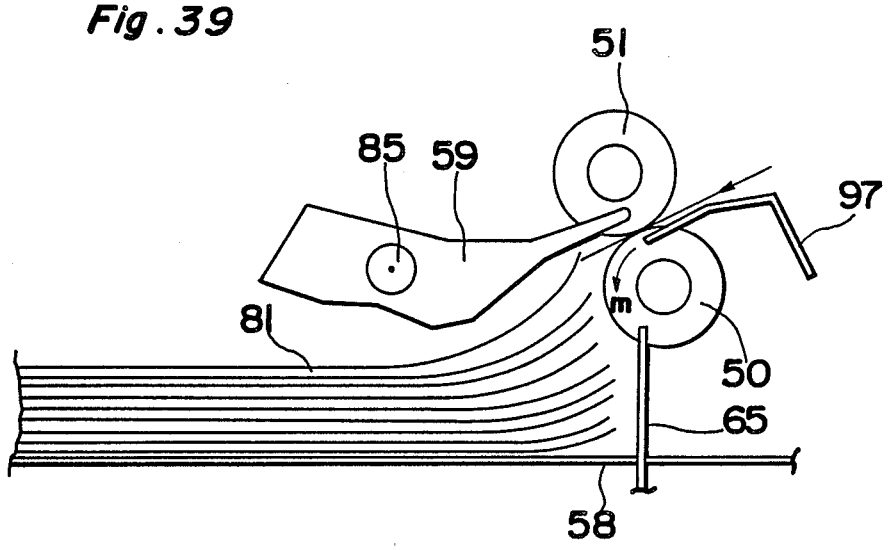
FIGS. 39 and 40 are views explanatory of operations of the copy paper transport portion of FIG. 37.
Figure 40:
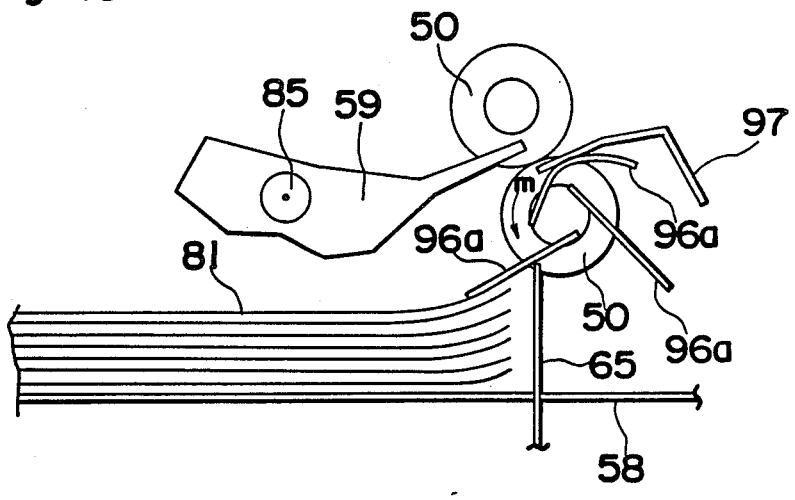

Furthermore, an auxiliary alignment mechanism for composite copying is described with reference to FIGS. 37 to 40. At the time of composite copying, the copy paper sheet 81 is guided by a guide plate 97 so as to be transported onto the intermediate tray 58 by the transport rollers 50 and 51 as shown in FIG. 39. If a number of the copy paper sheets 81 curled upwardly are transported onto the intermediate tray 58, the trailing edge of an upper one of the copy paper sheets 81 stacked on the intermediate tray 58 is raised above the point of contact between the transport rollers 50 and 51 and thus, jamming of the copy paper sheet 81 transported subsequently onto the intermediate tray 58 takes place. In this embodiment, in order to deal with this problem, the transport roller 50 is divided into a plurality of sections mounted on a support shaft 50*a* at a predetermined interval and a plurality of elastic blade members 96 each having a plurality of, for example three blades 96*a* are attached to arbitrary positions of the support shaft 50*a* as shown in FIG. 37. The elastic blade members 96 are disposed outwardly of the rear regulating plate 65 in the axial direction of the support shaft 50*a* so as to be brought into contact with the opposite lengthwise side portions of the copy paper sheet 81. The blades 96*a* of each of the elastic blade members 96 are disposed at an identical interval circumferentially and are inclined towards the rotational direction of the arrow m of the transport roller 50. As shown in FIG. 38, a length L of the blades 96*a* is larger than a radius R of the transport roller 50 such that the blades 96*a* overlap the rear regulating plate 65 through a distance G during rotation of the transport roller 50. Accordingly, the elastic blade members 96 are rotated together with the transport roller 50 in the direction of the arrow m and depress the upwardly deviating trailing edge of the curled copy paper sheet 81 so as to prevent jamming of the copy paper sheet 81.

Figure 9:
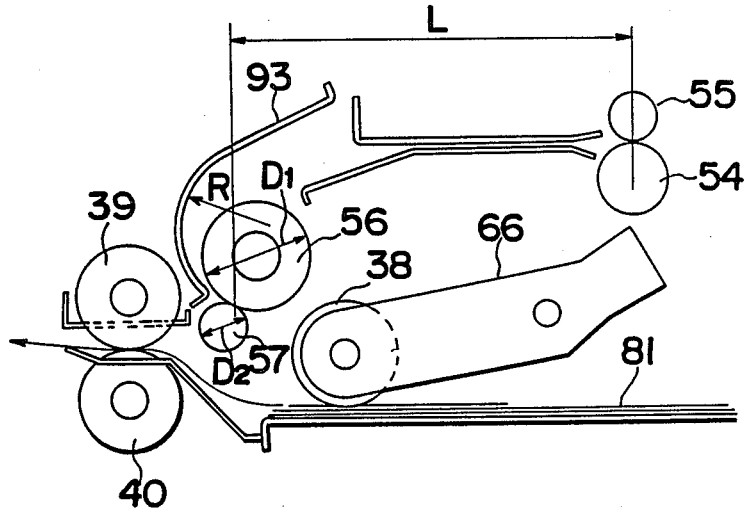
FIG. 9 is a view explanatory of relation between a re-feeding portion and transport rollers of a turnover block employed in the copying apparatus of FIG. 1.

Then, relation between the turnover transport rollers 56 and 57 and the turnover guide plate 93 is described with reference to FIG. 9. At the time of duplex copying, the turnover transport rollers 56 and 57 and the turnover guide plate 93 for turning over the copy paper sheet 81 immediately before transport of the copy paper sheet 81 onto the intermediate tray 58 are required to turn over a hard copy paper sheet such as a board or a soft copy paper sheet such as a thin paper or a curled copy paper sheet positively. The present inventors conducted experiments by setting a diameter D1 of the turnover transport roller 56, a diameter D2 of the turnover transport roller 57, a radius R of the turnover guide plate 93 and a distance L between the point of contact between the transport rollers 54 and 55 and that between the turnover transport rollers 56 and 57 to various values. As a result of the experiments, the present inventors have found the following points (a) to (d).

(a) In order to turn over a hard copy paper sheet, the diameters D1 and D2 and the radius R should be made large when the distance L is small.

(b) When the distance L is small, the transport rollers provided before the transport rollers 54 and 55 should be increased in number, thereby resulting in rise of production cost of the copying apparatus. Therefore, from the standpoint of the production cost of the copying apparatus, it is preferable that the distance L is made longer. The distance L is required to be at least as large as a length of a copy paper sheet of a minimum size.

(c) In order to turn over the copy paper sheet, the radius R and the diameter D1 are desirably made larger. However, if the radius R and the diameter D1 are made exceedingly large, the intermediate tray unit A is made large in size.

(d) In the intermediate tray unit A in which the copy paper sheet is turned over immediately before being transported onto the intermediate tray 58, the turnover transport rollers 56 and 57 are necessarily provided between the re-feeding roller 38 and the separating rollers 39 and 40. Furthermore, the turnover transport rollers 56 and 57 are required to be so provided as not to interfere with the copy paper sheet at the time of re-feeding of the copy paper sheet and as to make the intermediate tray unit A compact in size. To this end, it is preferable that diameters D1 and D2, especially the diameter D2 of the lower turnover transport roller 57 should be made as small as possible.

In order to effect smooth turnover of the copy paper sheet and make the intermediate tray unit A compact in size in view of the above described points (a) to (d), the following conditions (1) and (2) should be preferably satisfied.

$$D2 \leqq D1 \quad (1)$$

$$(D1/2) \leqq R \quad (2)$$

The above described conditions (1) and (2) are satisfied in this embodiment.

It should be noted here that the sheet aligning arrangement according to the present invention is not limited in its application to the foregoing embodiment alone but may be modified in various within the scope. For example, the sheet aligning arrangement of the present invention can be applied to an automatic document feeder of a type adapted to transport original documents through circulation as disclosed, e.g., in U.S. Pat. No. 4,278,344.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A sheet aligning arrangement which is arranged to accommodate a plurality of sheets fed thereinto for alignment, and to feed out the aligned sheets therefrom one sheet by one sheet, said sheet aligning apparatus comprising:

feed roller means for feeding the sheets;

a slidable alignment member slidable between a first position which defines a first sheet aligning reference position and a second position parallel to said first position and defining a first sheet transport reference position;

a pivotable alignment member located in a position confronting said slidable alignment member, and being pivotable about a fixed axis extending in a direction parallel to a sheet transport direction; and slidable alignment member displacing means for positioning the slidable alignment member in the first position during a preliminary alignment of the sheets carried out by the pivotable alignment member and for sliding the slidable alignment member to the second position and maintaining the slidable alignment member at the second position during a final alignment of the sheets carried out by the pivotable alignment member at the time of feeding of the sheets by the feed roller means.

2. A sheet aligning arrangement as claimed in claim 1, further comprising a pivotable alignment member displacing means for pivoting said pivotable alignment member about the fixed axis to place the sheets fed into the arrangement in contact with the slidable alignment member located at the first position during the preliminary alignment of the sheets, and for pivoting said pivotable alignment member about the fixed axis toward a fixed position parallel to said second position of the slidable alignment member and defining a second sheet transport reference position during the feeding of the sheets by said feed roller means.

3. A sheet aligning arrangement which is arranged to accommodate a plurality of sheets fed thereinto for alignment, and to feed out the aligned sheets therefrom through a sheet feeding passage one sheet by one sheet, said sheet aligning apparatus comprising:

a feed roller for feeding the sheets;

a slidable alignment member slidable between a first position which defines a first sheet aligning reference position and a second position parallel to said first position and defining a first sheet transport reference position;

a pivotable alignment member located in a position confronting said slidable alignment member and parallel to said second position of the slidable alignment member, the pivotable alignment member being pivotable about a fixed axis to a fixed position defining a second sheet transport reference position;

slidable alignment member displacing means for sliding said slidable alignment member to the first position during a preliminary alignment of the sheets, and for sliding said slidable alignment member to the second position during a final alignment and feeding of the sheets; and a pivotable alignment member pivoting means for pivoting said pivotable alignment member about said fixed axis to place the sheets fed into the arrangement in contact with the slidable alignment member located at the first position during the preliminary alignment of the sheets, and for pivoting said pivotable alignment member about said fixed axis toward said fixed position to place the sheets fed into the arrangement in contact with said slidable alignment member located at said second position for final alignment of the sheets during the feeding of the sheets by said feed roller.

4. A sheet aligning arrangement as claimed in claim 3, further comprising a leading edge aligning member located between said slidable and pivotable alignment members for positioning a sheet feeding direction leading edge of the sheets, said leading edge aligning member being adapted to retreat from the sheet feeding passage during feeding of the sheets.

5. A sheet aligning arrangement for use in a copying apparatus, arranged to receive a plurality of paper sheets each copied at one side thereof for alignment, and to feed the aligned paper sheets through a sheet feeding passage one sheet by one sheet, said sheet aligning arrangement comprising:

a feed roller for feeding the stacked paper sheets one sheet by one sheet, first and second aligning members of plate-like configuration provided in parallel relation to each other so as to accommodate the paper sheets therebetween, said first aligning member being slidable between a first position defining a first sheet aligning reference position and a second position defining a first sheet transport reference position parallel to said first position, and said second aligning member being parallel to said second position and pivotable about a fixed axis and positionable in a fixed position defining a second sheet transport reference position, the sheets fed into the arrangement being placed in contact with said first aligning member by repeated pivoting of said second aligning member about said fixed axis and through tapping one side edge of the sheets, and aligning member displacing means for sliding said first aligning member to said first position during a preliminary aligning of the sheets carried out by pivoting of said second aligning member to place the paper sheets fed into the arrangement in contact with said first aligning member located at said first position, and, during feeding of the paper sheets one sheet by one sheet by said feed roller, for sliding said first aligning member to said second position during a final aligning of the sheets carried out by pivoting of said second aligning member to said fixed position so as to place the paper sheets fed into the arrangement in contact with said first aligning member located at said second position.

6. A sheet aligning arrangement as claimed in claim 5, further comprising a leading edge aligning member of a plate-like configuration located between said first and second aligning members for positioning a sheet feeding direction leading edge of each of the sheets, said leading edge aligning member being adapted to retreat from the sheet feeding passage during feeding of the paper sheets one sheet by one sheet by the feed roller.

7. A sheet aligning arrangement as claimed in claim 5, wherein said sheet aligning arrangement is detachably mounted on a main body of the copying apparatus.

8. A sheet aligning arrangement which is arranged to accommodate a plurality of sheets fed thereinto for alignment, and to feed out the aligned sheets therefrom one sheet by one sheet, said sheet aligning apparatus comprising:

a feed roller means for feeding the sheets;

a first aligning member slidable between a first position which defines a first sheet aligning reference position and a second position defining a first sheet transport reference position located at a position different from said first position;

a second aligning member located in a position confronting said first aligning member, and being pivotable about a fixed axis extending in a direction parallel to a sheet transport direction; and first aligning member displacing means for sliding said first aligning member to said first position during a preliminary alignment carried out by the second aligning member, and for sliding said first aligning member to said second position during a final alignment of the sheets carried out by the second aligning member.

9. A sheet aligning arrangement as claimed in claim 1, wherein the width between the first position and the fixed position is larger than the width of sheets to be accommodated in the direction perpendicular to the direction of transport of the sheets with the fixed position taken as a reference edge.

10. A sheet aligning arrangement as claimed in claim 3, wherein the width between the first position and the fixed position is larger than the width of sheets to be accommodated in the direction perpendicular to the direction of transport of the sheets with the fixed position taken as a reference edge.

11. A sheet aligning arrangement as claimed in claim 5, wherein the width between the first position and the fixed position is larger than the width of sheets to be accommodated in the direction perpendicular to the direction of transport of the sheets with the fixed position taken as a reference edge.

* * * * *